US006554063B2

(12) United States Patent
Ohmer

(10) Patent No.: US 6,554,063 B2
(45) **Date of Patent: *Apr. 29, 2003**

(54) APPARATUS FOR ESTABLISHING BRANCH WELLS FROM A PARENT WELL

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 46 days.

This patent is subject to a terminal disclaimer.

(21) Appl. No.: 09/902,131

(22) Filed: Jul. 10, 2001

(65) Prior Publication Data

US 2002/0014333 A1 Feb. 7, 2002

Related U.S. Application Data

(60) Division of application No. 09/518,365, filed on Mar. 3, 2000, now Pat. No. 6,349,769, which is a continuation of application No. 08/898,700, filed on Jul. 24, 1997, now Pat. No. 6,056,059, which is a continuation-in-part of application No. 08/798,591, filed on Feb. 11, 1997, now Pat. No. 5,944,107

(60) Provisional application No. 60/025,033, filed on Aug. 27, 1996, provisional application No. 60/022,781, filed on Jul. 30, 1996, and provisional application No. 60/013,227, filed on Mar. 11, 1996.

(51) Int. Cl.[7] ..... E21B 7/06; E21B 43/14

(52) U.S. Cl. ..... 166/50; 166/117.6; 166/242.1

(58) Field of Search ..... 166/242.1, 242.2, 166/242.3, 313, 50, 117.6

(56) References Cited

U.S. PATENT DOCUMENTS 5,388,648 A * 2/1995 Jordan, Jr. ..... 166/117.5
5,915,474 A * 6/1999 Buytaert et al. ..... 166/117.6
5,941,308 A * 8/1999 Malone et al. ..... 166/242.3
5,944,107 A * 8/1999 Ohmer ..... 166/117.6
5,979,560 A * 11/1999 Nobileau ..... 166/117.6
6,089,320 A * 7/2000 LaGrange ..... 166/117.5
6,253,852 B1 * 7/2001 Nobileau ..... 166/313

FOREIGN PATENT DOCUMENTS

FR 2737534 * 2/1997
WO 96/23953 * 8/1996

* cited by examiner

*Primary Examiner*—Hoang Dang
(74) *Attorney, Agent, or Firm*—Trop, Pruner & Hu, P.C.; Jeffrey E. Griffin; Brigitte L. Jeffery

(57) ABSTRACT

A method and apparatus for creating multiple branch wells from a parent well is disclosed. According to a first embodiment of the invention a multiple branching sub is provided for placement at a branching node of a well. Such sub includes a branching chamber and a plurality of branching outlet members. The outlet members, during construction of the branching sub, have previously been distorted into oblong shapes so that all of the branching outlet members fit within an imaginary cylinder which is coaxial with and substantially the same radius as the branching chamber. According to one embodiment, the distorted outlet members are characterized by an outer convex shape. In another embodiment, the distorted outlet members are characterized by an outer concave shape when in a retracted state. After deployment of the branching sub via a parent casing in the well, a forming tool is lowered to the interior of the sub. The outlet members are extended outwardly by the forming tool and simultaneously formed into substantially round tubes. Next, each outlet member is plugged with cement, after which each branch well is drilled through a respective outlet member. If desired, each branch may be lined with casing and sealed to a branching outlet by means of a casing hanger. A manifold placed in the branching chamber controls the production of each branch well to the parent well. According to a second embodiment of the invention, a pressure resistant branching sub is provided which may be installed in series with a casing string, and the associated equipment used for the installation operation and intervention of a well. The branching sub includes a main pipe and a lateral outlet.

28 Claims, 33 Drawing Sheets

Ds1=Ds2 → Dc/Do=1.35
Sc/So=1.82

FIG. 5A
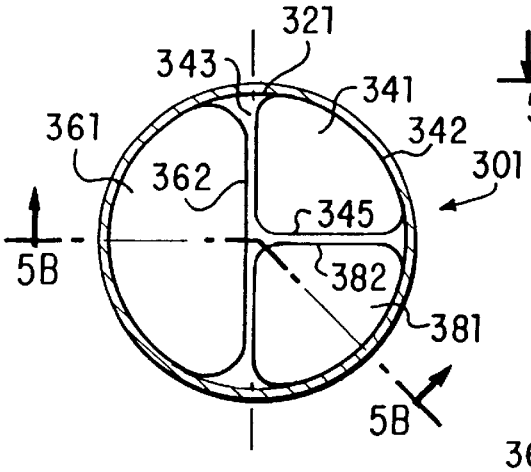
FIG. 5B
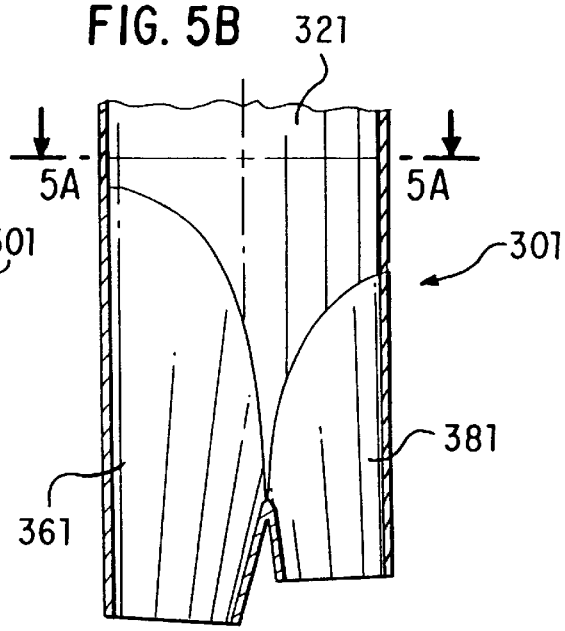
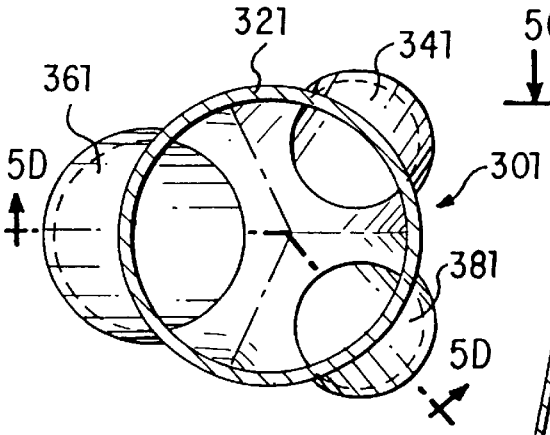
FIG. 5C
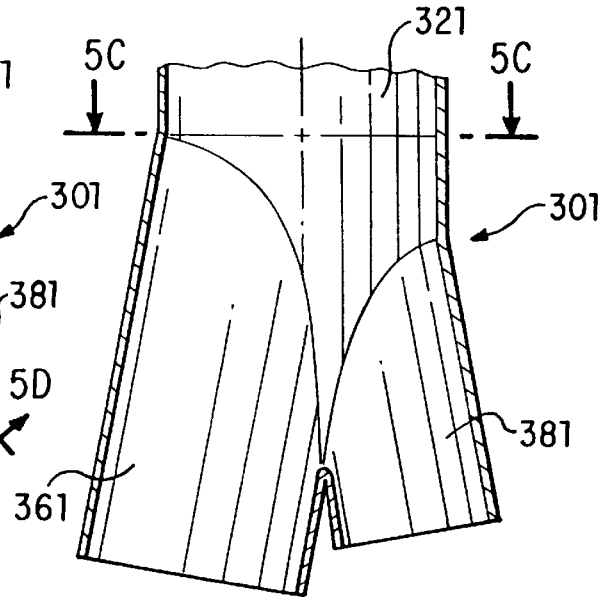
FIG. 5D $C = \pi \times Ds/2 + Ds$
$Dc = Ds/2$
$Do = C/\pi = Ds/2 + Ds/\pi$ $C = \pi \times Ds/3 + Ds$
$Dc = 3Ds/(3 + 2\sqrt{3})$
$Do = C/\pi = Ds/3 + Ds/\pi$ FIG. 14A
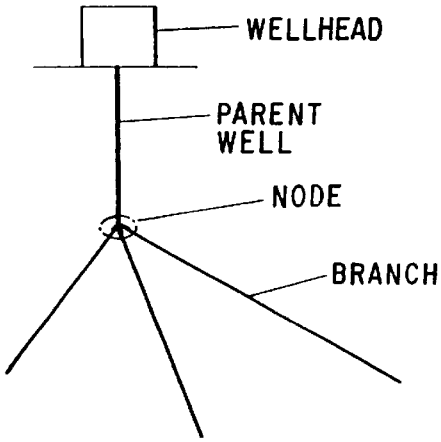
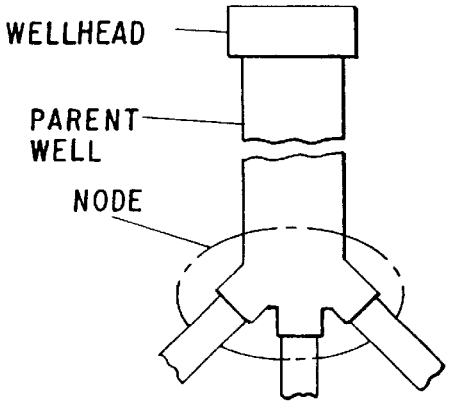
FIG. 14B
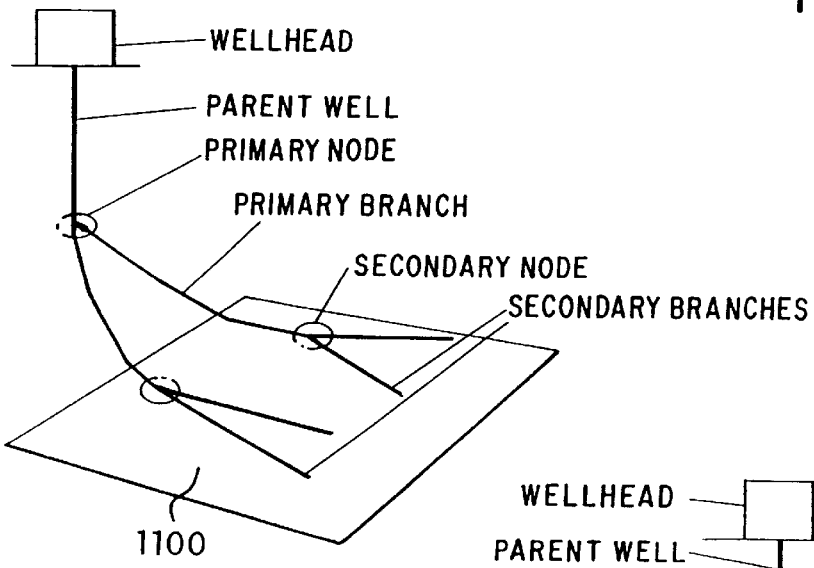
FIG. 14C
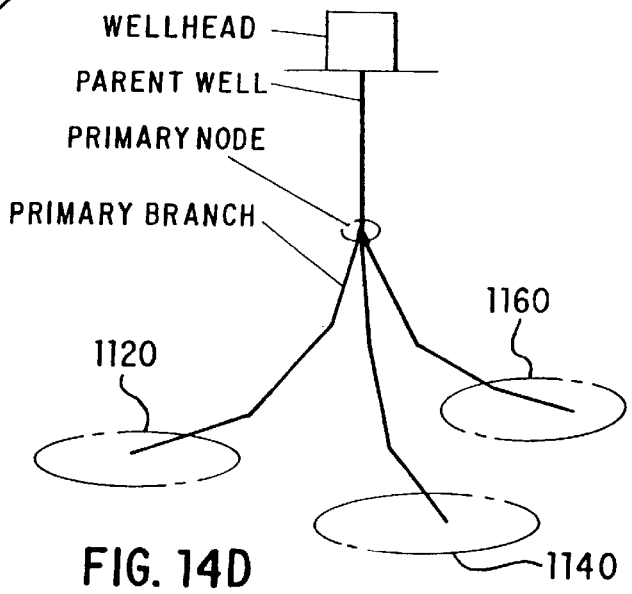
FIG. 14D

A: YIELD STRENGTH BEFORE DEFORMATION
B: YIELD STRENGTH AFTER DEFORMATION

APPARATUS FOR ESTABLISHING BRANCH WELLS FROM A PARENT WELL

CROSS-REFERENCE TO RELATED APPLICATIONS

This application is a Divisional of application Ser. No. 09/518,365 filed Mar. 3, 2000 now U.S. Pat. No. 6,349,769 which is a continuation of application Ser. No. 08/898,700, filed Jul. 24, 1997 (now U.S. Pat. No. 6,056,059), which is a continuation-in-part of application Ser. No. 08/798,591, filed Feb. 11, 1997 (now U.S. Pat. No. 5,944,107), which claimed priority under 35 U.S.C. §119(e) from Provisional Application No. 60/013,227 filed Mar. 11, 1996 and Provisional Application 60/025,033, filed Aug. 27, 1996. The '700 Application claimed further priority under 35 U.S.C. §119 (e) from Provisional Application 60/022,781, filed Jul. 30, 1996, the contents of which are incorporated herein by reference.

BACKGROUND OF THE INVENTION

1. Field of the Invention

This invention relates generally to the field of wells, particularly to the field of establishing branch wells from a parent hydrocarbon well. More particularly the invention relates to establishing multiple branch wells from a common depth point, called a node, deep in the well.

2. Description of the Related Art

Multiple wells have been drilled from a common location, particularly while drilling from an offshore platform where multiple wells must be drilled to cover the great expenses of offshore drilling. As illustrated in FIGS. 1A and 1B, such wells are drilled through a common conductor pipe, and each well includes surface casing liners, intermediate casing and parent casing as is well known in the field of offshore drilling of hydrocarbon wells. U.S. Pat. No. 5,458,199 describes apparatus and methods for drilling multiple wells from a common wellbore at or near the surface of the earth. U.S. Pat. No. 4,573,541 describes a downhole take-off assembly for a parent well which includes multiple take-off tubes which communicate with branched wells from a common point.

Branch wells are also known in the art of well drilling which branch from multiple points in the parent well as illustrated in FIG. 2. Branch wells are created from the parent well, but necessarily the parent well extends below the branching point of the primary well. As a result, the branching well is typically of a smaller diameter than that of the primary well which extends below the branching point. Furthermore, difficult sealing problems have faced the art for establishing communication between the branch well and the primary well.

For example, U.S. Pat. No. 5,388,648 describes methods relating to well juncture sealing with various sets of embodiments to accomplish such sealing. The disclosure of the >648 patent proposes solutions to several serious sealing problems which are encountered when establishing branches in a well. Such sealing problems relate to the requirement of ensuring the connectivity of the branch casing liner with the parent casing and to maintaining hydraulic isolation of the juncture under differential pressure.

A fundamental problem exists in establishing branch wells at a depth in a primary well in that apparatus for establishing such branch wells must be run on parent casing which must fit within intermediate casing of the well. Accordingly, any such apparatus for establishing branch wells must have an outer diameter which is essentially no greater than that of the parent casing. Furthermore, it is desirable that when branch wells are established, they have as large a diameter as possible. Still further, it is desirable that such branch wells be lined with casing which may be established and sealed with the branching equipment with conventional casing hangers.

An important object of this invention is to provide an apparatus and method by which multiple branches connect to a primary well at a single depth in the well where the branch wells are controlled and sealed with respect to the primary well with conventional liner-to-casing connections.

Another important object of this invention is to provide a multiple outlet branching sub having an outer diameter such that it may be run in a well to a deployment location via primary casing.

Another object of this invention is to provide a multiple outlet branching sub in which multiple outlets are fabricated in a retracted state and are expanded while downhole at a branching deployment location to produce maximum branch well diameters rounded to provide conventional liner-to-casing connections.

Another object of this invention is to provide apparatus for downhole expansion of retracted outlet members in order to direct each outlet into an arcuate path outwardly from the axis of the primary well and to expand the outlets into an essentially round shape such that after a branch well is drilled through an outlet, conventional liner-to-casing connections can be made to such outlet members.

SUMMARY OF THE INVENTION

These objects and other advantages and features are provided in a method and apparatus for establishing multiple branch wells from a parent well. A multiple branching sub is provided for deployment in a borehole by means of a parent casing through a parent well. The branching sub includes a branching chamber which has an open first end of cylindrical shape. The branching chamber has a second end to which branching outlet members are connected. The first end is connected to the parent well casing in a conventional manner, such as by threading, for deployment to a branching location in the parent well.

Multiple branching outlet members, each of which is integrally connected to the second end of the branching chamber, provide fluid communication with the branching chamber. Each of the outlet members is prefabricated such that such members are in a retracted position for insertion of the sub into and down through the parent well to a deployment location deep in the well. Each of the multiple outlets is substantially totally within an imaginary cylinder which is coaxial with and of substantially the same radius as the first end of the branching chamber. The prefabrication of the outlet members causes each outlet member to be transformed in cross-sectional shape from a round or circular shape to an oblong or other suitable shape such that its outer profile fits within the imaginary cylinder. The outer profile of each outlet member cooperates with the outer profiles of other outlet members to substantially fill the area of a cross-section of the imaginary cylinder. As a result, a substantially greater cross-sectional area of the multiple outlet members is achieved within a cross-section of the imaginary cylinder as compared with a corresponding number of tubular multiple outlet members of circular cross-section.

The multiple outlet members are constructed of a material which may be plastically deformed by cold forming. A forming tool is used, after the multiple branching sub is deployed in the parent well, to expand at least one of the multiple branching outlet members outwardly from the connection to the branching chamber. Preferably all of the outlet members are expanded simultaneously. Simultaneously with the outward expansion, the multiple outlets are expanded into a substantially circular radial cross-sectional shape along their axial extent.

After the multiple outlet members which branch from the branching chamber are expanded, each of the multiple branching outlets are plugged. Next, a borehole is drilled through a selected one of the multiple branching outlets. A substantially round liner is provided through the selected branching outlet and into the branch well. The liner of circular cross-section is sealed to the selected branching outlet circular cross-section by means of a conventional casing hanger. A borehole and liner is established for a plurality of the multiple branching outlets. A downhole manifold is installed in the branching chamber. Next multiple branch wells are completed. The production of each branch well to the parent well is controlled with the manifold.

The apparatus for expanding an outlet of the multiple branching sub includes an uphole power and control unit and a downhole operational unit. An electrical wireline connects the uphole power and control unit and the downhole operational unit. The wireline provides a physical connection for lowering the downhole operational unit to the branching sub and provides an electrical path for transmission of power and bidirectional control and status signals.

The downhole operational unit includes a forming mechanism arranged and designed for insertion in at least one retracted branching outlet member of the sub (and preferably into all of the outlet members at the same time) and for expanding the outlet member outwardly from its imaginary cylinder at deployment. Preferably each outlet member is expanded outwardly and expanded to a circular radial cross-section simultaneously. The downhole operational unit includes latching and orientation mechanisms which cooperate with corresponding mechanisms of the sub. Such cooperating mechanisms allow the forming mechanism to be radially oriented within the multiple branching sub so that it is aligned with a selected outlet of the sub and preferably with all of the outlets of the sub. The downhole operational unit includes a hydraulic pump and a head having hydraulic fluid lines connected to the hydraulic pump. The forming mechanism includes a hydraulically powered forming pad. A telescopic link between each forming pad and head provides pressurized hydraulic fluid to the forming pads as they move downwardly while expanding the outlet members.

According to a second, alternative embodiment of the invention, a branching sub is provided which allows multiple branches from a parent casing without the need for sealing joints and which allows the use of conventional well controlled liner packers and casing joints. The geometry of the housing of the branching sub allows the housing to achieve maximum pressure rating considering the size of the branch outlet with regard to the size of the parent casing.

BRIEF DESCRIPTION OF THE DRAWINGS

The objects, advantages and features of the invention will become more apparent by reference to the drawings which are appended hereto and wherein an illustrative embodiment of the invention is shown, of which:

FIG. 3A is a radial cross-section through the branching outlets of the sub, with one outlet completely in a retracted position, with another outlet in a position between its retracted position and its fully expanded position, and the third outlet being in a fully expanded position, and where FIG. 3B is a radial cross-section through the branching outlets of the sub with each of the outlets fully expanded after deployment in a parent well, and FIG. 3C is an axial cross-section of the branching sub showing two of the branching outlets fully expanded to a round shape in which casing has been run into a branch well and sealed with respect to the branching outlets by means of conventional liner hanging packers.

FIGS. 5A, 5B, 5C, and 5D illustrate configurations of the first embodiment of the invention with asymmetrical branching outlets with at least one outlet having larger internal dimensions than the other two, with FIG. 5A being a radial cross-section through the branching outlets along line 5A—5A in a retracted position, with FIG. 5B being an axial cross-section through the lines 5B—5B of FIG. 5A, with FIG. 5C being a radial cross-section along lines 5C—5C of FIG. 5D with the branching outlets in an expanded position, and with FIG. 5D being an axial cross-section along lines 5D—5D of FIG. 5C with the branching outlets in an expanded position;

FIGS. 14A–14D are illustrative sketches of nodal branching according to the invention where FIG. 14A illustrates establishing a node in a parent well and establishing branch wells at a common depth point in the parent well, all of which communicate with a parent well at the node of the parent well; with FIG. 14B illustrating an expanded branching sub which has had its branching outlets expanded beyond the diameter of the parent casing and formed to be substantially round; with FIG. 14C illustrating using a primary node and secondary nodes to produce hydrocarbons from a single strata; and with FIG. 14D illustrating using an expanded branching sub from a primary node to reach multiple subterranean targets;

FIG. 20A is an exterior view of a branching sub with a main pipe and a lateral branching outlet and FIG. 20B is an axial section view of such branching sub;

DESCRIPTION OF THE PREFERRED EMBODIMENTS

Figure 1A:
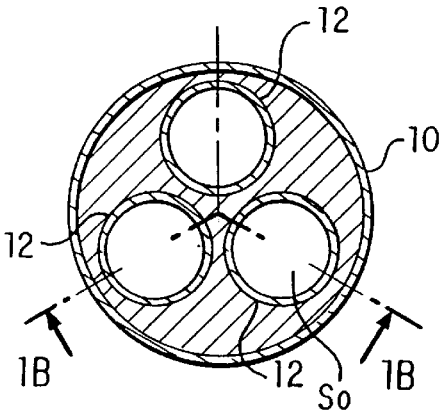
FIG. 1A PRIOR ART
FIGS. 1A and 1B illustrate a prior art triple liner packed in a conductor casing termination in which the outlet members are round during installation and are packed to fit within the conductor casing.
Figure 1B:
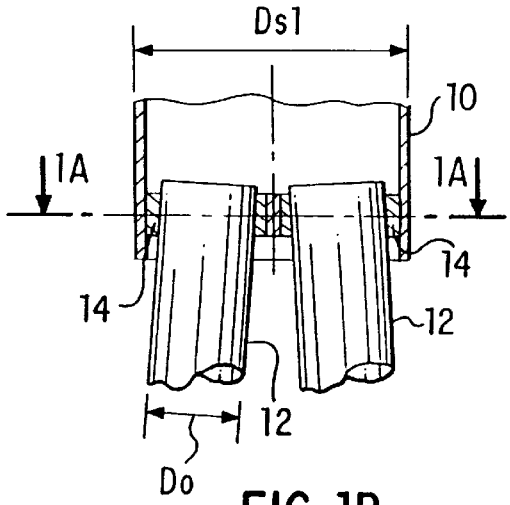
FIG. 1B PRIOR ART

As described above, FIGS. 1A and 1B illustrate the problems with prior art apparatus and methods for establishing branch wells from a parent well. FIGS. 1A and 1B show radial and axial cross-sections of multiple outlet liners 12 hung and sealed from a large diameter conductor pipe 10. The outlets are round in order to facilitate use of conventional lining hanger packers 14 to seal the outlet liners 12 for communication with the conductor pipe 10. The arrangement of FIGS. 1A and 1B requires that multiple round outlets of diameter $D_o$ fit within the diameter $D_s$1 of the conductor pipe 10. In many cases, especially where the conductor pipe must be deployed at a depth in the well, rather than at the surface of the well, it is not feasible to provide a borehole of sufficient outer diameter to allow branch well outlets of sufficient diameter to be installed.

Figure 2:
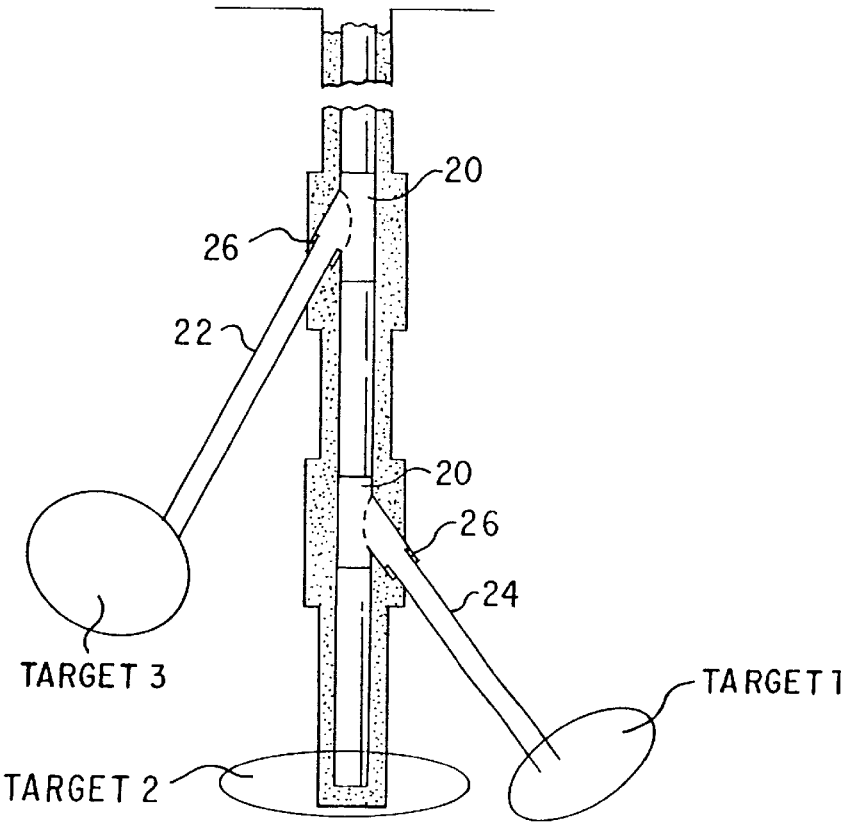
FIG. 2 PRIOR ART
FIG. 2 illustrates a prior art parent or vertical well and lateral branch wells which extend therefrom.

The technique of providing branch wells according to the prior art arrangement depicted in FIG. 2 creates branch wells 22, 24 from a primary well 20. Special sealing arrangements 26, unlike conventional casing hangers, must be provided to seal a lined branch well 22, 24 to the primary well 20.

Figure 3A:
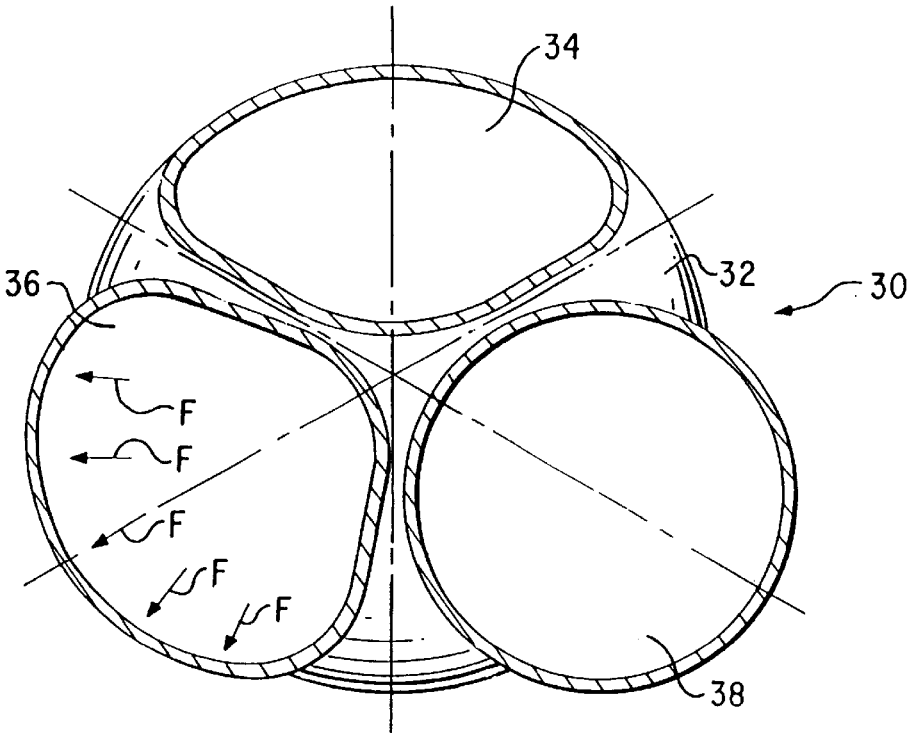
FIGS. 3A, 3B, and 3C illustrate a three outlet branching sub according to a first embodiment of the invention where
Figure 3B:
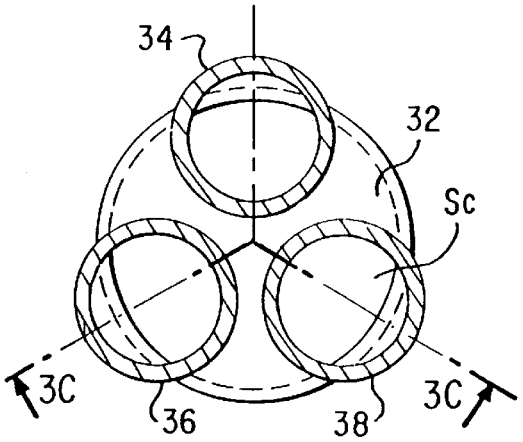
Figure 3C:
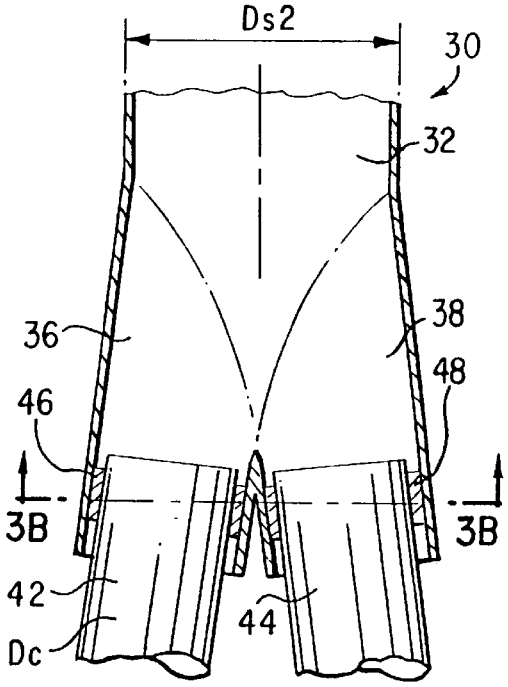

Description of Branching Sub According to a First Embodiment of the Invention FIGS. 3A, 3B, and 3C illustrate a branching sub 30 according to the invention. The branching sub includes a branching chamber 32, (which may be connected to and carried by parent well casing (See parent casing 604 of FIG. 12)), and multiple outlet members, for example three outlet members 34, 36, 38 illustrated in FIGS. 3A, 3B, and 3C. FIG. 3A is a radial cross-section view through the branching chamber 32 which illustrates one outlet member 34 in a retracted state, a second outlet member 36 in the state of being expanded outwardly, and a third outlet member 38 which has been fully expanded outwardly. (FIG. 3A is presented for illustrative purposes, because according to the invention it is preferred to expand and circularize each of the outlets simultaneously.) In the retracted state, each outlet is deformed as shown particularly for outlet member 34. A round tube is deformed such that its cross-sectional interior area remains essentially the same as that of a circular or round tube, but its exterior shape is such that it fits cooperatively with the deformed shape of the other outlet members, all within an imaginary cylinder having a diameter essentially the same as that of the branching chamber 32. In that way the branching chamber 32 and its retracted outlet members have an effective outer diameter which allows it to be run in a parent well to a deployment location while attached to a parent casing. Outlet member 34 in its retracted state is illustrated in an oblong shape, but other retracted shapes may also prove to have advantageous characteristics. For example, a concave central area of deformation in the outer side of a retracted outlet member may be advantageous to provide a stiffer outlet member.

Such deformation is progressively greater and deeper starting from the top to the bottom of the outlet member.

FIG. 3A shows outlet member 36 in a state of being expanded in an arcuate path outwardly from the branching chamber 32 while simultaneously being rounded by a downhole forming-expanding tool that is described below. The arrows labeled F represent forces being applied from the interior of the outlet member 36 in order to expand that outlet member both outwardly in an arcuate path away from branching chamber 32 and to circularize it from its retracted state (as is the condition of outlet member 34) to its expanded or fully deployed state like outlet member 38.

FIG. 3B is a radial cross-section as viewed by lines 3B—3B of FIG. 3C through the branching sub 30 at the level of outlet members 36, 38. FIG. 3C illustrates conventional casing liners 42, 44 which have been installed through branching chamber 32 and into respective outlet members 36, 38. Conventional liner hanging packers 46, 48 seal casing liners 42, 44 to outlet members 36, 38. As illustrated in FIGS. 3B and 3C, if the diameter $D_s$2 of the branching chamber 32 is the same as the diameter $D_s$1 of the conductor pipe of prior art FIG. 1B, then the outlet diameter $D_c$ of FIG. 3C is 1.35 times as great as the outer diameter $D_o$ of FIG. 1B. The liner cross-sectional area Sc of the sub of FIG. 3C is 1.82 times as great as the liner cross-sectional area $S_0$ of FIG. 1A. When fully expanded, the effective diameter of the expanded outlet members 34, 36, 38 exceeds that of the branching chamber 32.

Experiments have been conducted to prove the feasibility of manufacturing branching sub 30 with outlets in a retracted state, and later operationally expanding outwardly and rounding the outlets.

Experiment Phase 1

Two casing sizes were selected: a first one, one meter long was 7 inch diameter casing with a wall thickness of 4.5 mm; the second was one meter long and was 7 inch diameter casing with a wall thickness of 8 mm. A hydraulic jack was designed for placement in a casing for expanding it. Each casing was successfully preformed into an elliptical shape, e.g., to simulate the shape of outlet member 34 in FIG. 3A and reformed into circular shape while using a circularizing forming head with the jack. Circularity, like that of outlet member 38 of FIG. 3A was achieved with plus or minus difference from perfect circularity of 2 mm.

Experiment Phase 2

Two, one meter long, 7 inch diameter, 23 pound casings were machined axially at an angle of 2.5 degrees. The two casings were joined together at their machined surfaces by electron beam (EB) welding. The joined casings were deformed to fit inside an 11 inch diameter. The welding at the junction of the two casings and the casings themselves had no visible cracks. The maximum diameter was 10.7 inches; the minimum diameter was 10.5 inches.

a) Machinery

Before milling each casing at an angle of 2.5 degrees, a spacer was temporarily welded at its end to avoid possible deformation during machining. Next each casing was machined roughly and then finished to assure that each machined surface was coplanar with the other. The spacer welded at the end of the casing was machined at the same time.

b) Welding

The two machined casings were assembled together with a jig, pressed together and carefully positioned to maintain alignment of the machined surfaces. The assembly was then fixed by several tungsten inert gas (TIG) spot welds and the jig was removed. In an EB welding chamber, the two machined casings were spot welded alternately on both sides to avoid possible deformation which could open a gap between the two surfaces . Next, about 500 mm were EB welded on one side; the combination was turned over and EB welded on the other side. Finally the bottom of the combination was EB welded and turned over again to complete the welding. The result was satisfactory; the weld fillet was continuous without any loss of material. As a result, the two machined surfaces of the casings were joined with no gap.

c) Deformation

Deformation was done with a special jig of two portions of half cylinders pushed against each other by a jack with a force of 30 metric tons (66,000 pounds). The half cylinders had an inside diameter which was slightly smaller than 11 inches. Accordingly, the final diameter of the deformed assembly was less than 11 inches when the junction was deformed. Pliers were placed inside the junction to aid deformation of the outlet where it is critical: at the end of the tube where the deformation is maximal.

A large wedge with a 5 degree angle was installed between the two outlets to facilitate flattening them when deforming. The deformation started at the outlets. Force was applied on the pliers and simultaneously on the jack. A force of about one ton was continuously applied to the pliers; the outside jig was moved down in steps of 125 mm; at each step a force of 15 metric tons (33,000 pounds) was applied. The operation was repeated with a force of 20 metric tons (44,000 pounds), and the end of the outlets started to flatten on the wedge. The process was completed at a force of 30 metric tons (66,000 pounds). The resulting deformed product was satisfactory.

It is preferred to modify the shape of the pliers in such a way that the pliers deform the outlet with a smooth angle and to weld the wedge after deformation, rather than before, and to weld it by using two large wedges on each side of it to avoid a Anegative≈deformation of this area.

Experiment Phase 2 was conducted a second time, but with a steel sheet metal stiffener welded along the EB welds of both sides of the junction of the two casings. The junction was deformed as in Experiment Phase 2 to fit within an 11 inch diameter. A jack with a force of 30 metric tons (66,000 pounds) was used. Pliers, as for the first junction, were not used. A large wedge was used for the first junction with a 5 degree angle cut in two and installed on each side of the welded wedge between the two outlets to facilitate flattening of the outlets when deforming. The deformation started at the outlets and continued toward the junction. This operation was repeated with a force of 30 metric tons. The end of the outlets started to flatten on the wedge. The portion most difficult to deform was around the junction of the casings where the outlets are complete inside but welded together, where the welded surface is between the top of the inside ellipse and the top of the outside ellipse. As a result of this experiment, a higher capacity jack of 50 metric tons force was provided.

Experiment Phase 3

A full length prototype with two 7 inch casings connected to a 9⅝ inch casing was manufactured and pressure tested. Testing stopped at 27 bar because deformation was occurring without pressure variation.

a) Machining

Machining was performed in the same way as for the two previous junctions except that the length of the casings was 1.25 meters instead of 1 meter, and a groove was machined around the elliptical profile to enhance the EB welding process. Additionally, a blind hole was machined on the plane of the cut of each casing to install a pin between the two casings to provide better positioning. The upper adapter was machined out of a solid bar of steel on a numerically controlled milling machine to provide a continuous profile between the 7 inch casings, with a 2.5 degree angle, and the 9⅝ inch casing. The adapter was machined to accept a plug. The inner diameter of the lower end of the 7 inch casings was machined to accept the expanding plugs.

b) Welding

The two machined casings were assembled together with a jig and pressed together. The assembly was then fixed together by several spot TIG welds and the jig was removed. In an EB chamber, the two parts were EB spot welded alternately on both sides to avoid possible deformation. Then the two casings were EB welded on one side; the assembly was turned over and EB welded on the other side. The assembled casings were joined satisfactorily. An adapter was then TIG welded on the assembled casings as well as a wedge in between the 7 inch casings.

c) Pressure Testing

Deformation during pressure testing was measured using two linear potentiometers placed on the EB weld. The pressure was increased by steps of 5 bar, and the value of the potentiometer was recorded at atmospheric pressure, at the given pressure, and when returned to atmospheric pressure. As a result of such pressure testing, it was determined that the total plastic deformation of the casings near their junction was 4.7 mm and outwardly of their junction was 3.7 mm.

Experiment Phase 3 showed that the deformation at 27 bar was too high. Nevertheless, the deformation was localized in a small area. The upper adapter and the large casing welding act as stiffeners. It was determined to add a stiffener in the plane of welding which can be Aanchored≈in the area of low deformation.

Experiment Phase 4

A full length prototype with two 7 inch casings (9 mm thickness) connected to a 9⅝ inch casing was deformed to fit inside a 10.6 inch cylinder. This deformation was performed using the same jig used for Experiment Phase 3, but with a jack with 50 metric tons capacity instead of 30 metric tons.

a) Deformation Jig

The deformation jig was modified to accept a higher deforming force and the bar which supports the fixed half shell was reinforced. The jig was bolted on a frame and a crane was included in the frame to lift the junction and displace it during the deformation process.

b) Deforming Process

The change of dimension of the joined casing during deformation was measured using a sliding gauge. Such change of dimension was measured before applying the pressure, under pressure and after releasing the pressure. Deformation started at the middle of the junction where it is stiffest and continued toward the ends of the outlets because the deformation must be larger at the outlets. The deformation on the bottom of the junction was too high on the first run and reached nearly 10 inches. At the middle of the junction, the deformation was about 10.6 inches. Except for the bottom end which was deformed too much with negative curvature around the wedge, the remainder of the junction stayed around 10.6 inches. The maximum pressure applied was 670 bar which required a force of 48 metric tons. For joining and deforming casings of thicker tubes, the jig must be rebuilt to accept large deforming forces.

c) Conclusion

The deformation of the prototype of Experiment Phase 4 was conducted easily with the new jig. The casings were reopened to the original shape.

Figure 4:
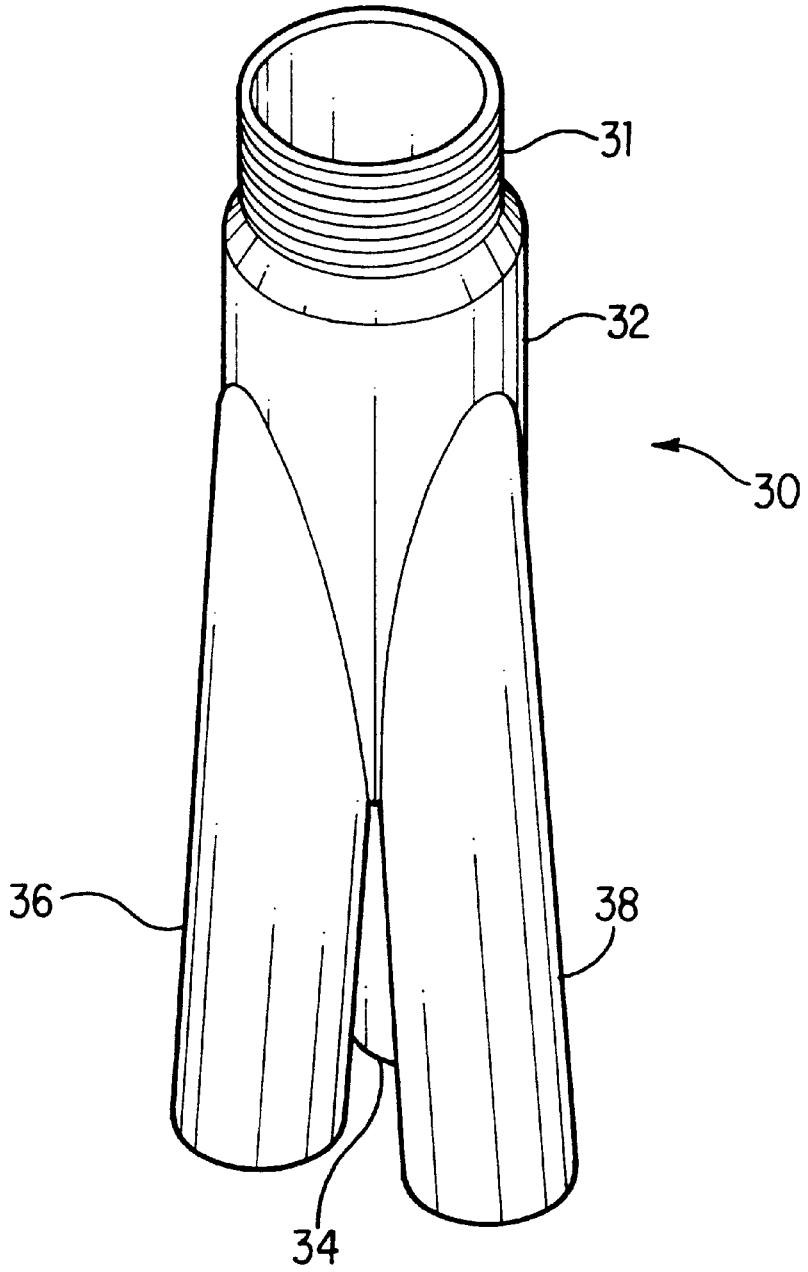
FIG. 4 is a perspective view of a three symmetrical outlet branching sub of a first embodiment of the invention with the outlet branches expanded.

FIG. 4 is a perspective view of the branching sub 30 of FIGS. 3A, 3B, 3C where the branching sub is shown after expansion. Threads 31 are provided at the top end of branching chamber 32. Threads 31 enable branching sub 30 to be connected to a parent casing for deployment at a subterranean location. Outlet members 34, 36, 38 are shown expanded as they would look downhole at the end of a parent well.

FIGS. 5A–5D illustrate an alternative three outlet branching sub 301 according to the invention. FIGS. 5A and 5B illustrate in radial and axial cross-section views the sub 301 in its retracted position. Outlet members 341, 361 and 381 are illustrated with outlet member 361 being about equal to the combined radial cross-sectional area of outlet members 341 and 381 combined. Each of the outlet members are deformed inwardly from a round tubular shape to the shapes as illustrated in FIG. 5A whereby the combined deformed areas of outlet members 341,361 and 381 substantially fill the circular area of branching chamber 321. Other deformation shapes may be advantageous as mentioned above. Each deformed shape of outlet members 341, 361 and 381 of FIG. 5A is characterized by (for example, of the outlet member 341) a circular outer section 342 and one or more connecting, non-circular sections 343, 345. Such non-circular sections 343,345 are cooperatively shaped with section 362 of outlet member 361 and 382 of outlet member 381 so as to maximize the internal radial cross-sectional areas of outlet members 341, 361 and 381.

FIGS. 5C and 5D illustrate the branching sub 301 of FIGS. 5A and 5B after its outlet members have been fully expanded after deployment in a parent well. Outlet members 361 and 381 are illustrated as having been simultaneously expanded in a gently curving path outwardly from the axis of branching chamber 321 and expanded radially to form circular tubular shapes from the deformed retracted state of FIGS. 5A and 5B.

Figure 6A:
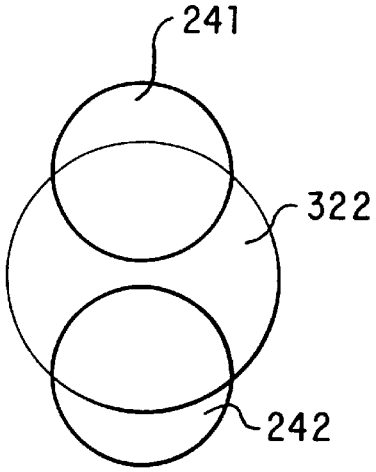
FIGS. 6A–6E illustrate radial cross-sections of several examples of branching outlet configurations of the branching sub according to the first embodiment of the invention, with all outlet branches fully expanded from their retracted state during deployment in a parent well, with FIG. 6A illustrating two equal diameter outlet branches, FIG. 6B illustrating three equal diameter outlet branches, FIG. 6C, like FIG. 5C, illustrating three outlet branches with one branch characterized by a larger diameter than the other two, with FIG. 6D illustrating four equal diameter outlet branches, and with FIG. 6E illustrating five outlet branches with the center branch being of smaller diameter than the other four.
Figure 6B:
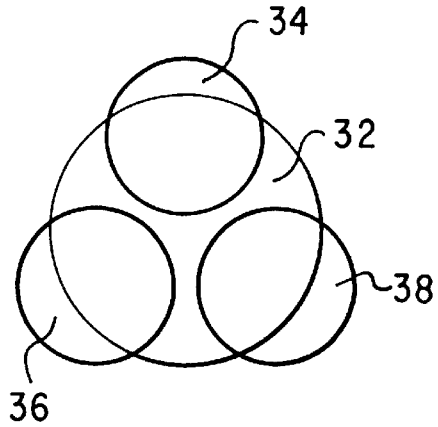
Figure 6C:
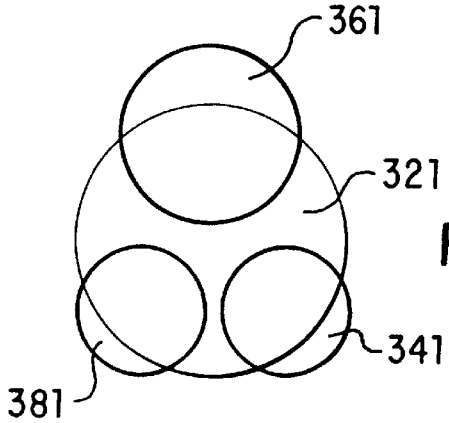
Figure 6D:
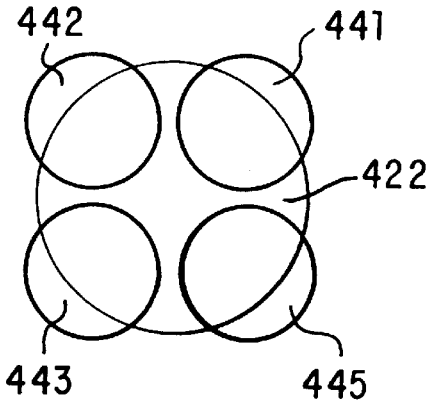
Figure 6E:
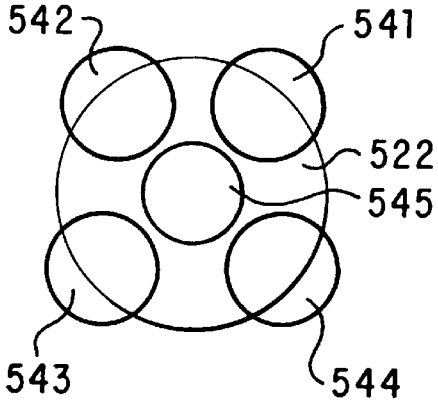

FIGS. 6A–6E show in schematic form the size of expanded outlet members as compared to that of the branching chamber. FIG. 6A shows two outlet members 241, 242 which have been expanded from a deformed retracted state. The diameters of outlet members 241 and 242 are substantially greater in an expanded state as compared to their circular diameters if they could not be expanded. FIG. 6B repeats the case of FIG. 3B. FIG. 6C repeats the uneven triple outlet configuration as shown in FIGS. 5A–5D. FIG. 6D illustrates four expandable outlet members from a branching chamber 422. Each of the outlet members 441, 442, 443, 445 are of the same diameter. FIG. 6E illustrates five outlet members, where outlet member 545 is smaller than the other four outlet members 541, 542, 543, 544. Outlet member 545 may or may not be deformed in the retracted state of the branching sub.

Description of Method for Expanding a Deformed Retracted Outlet Member

Figure 7A:
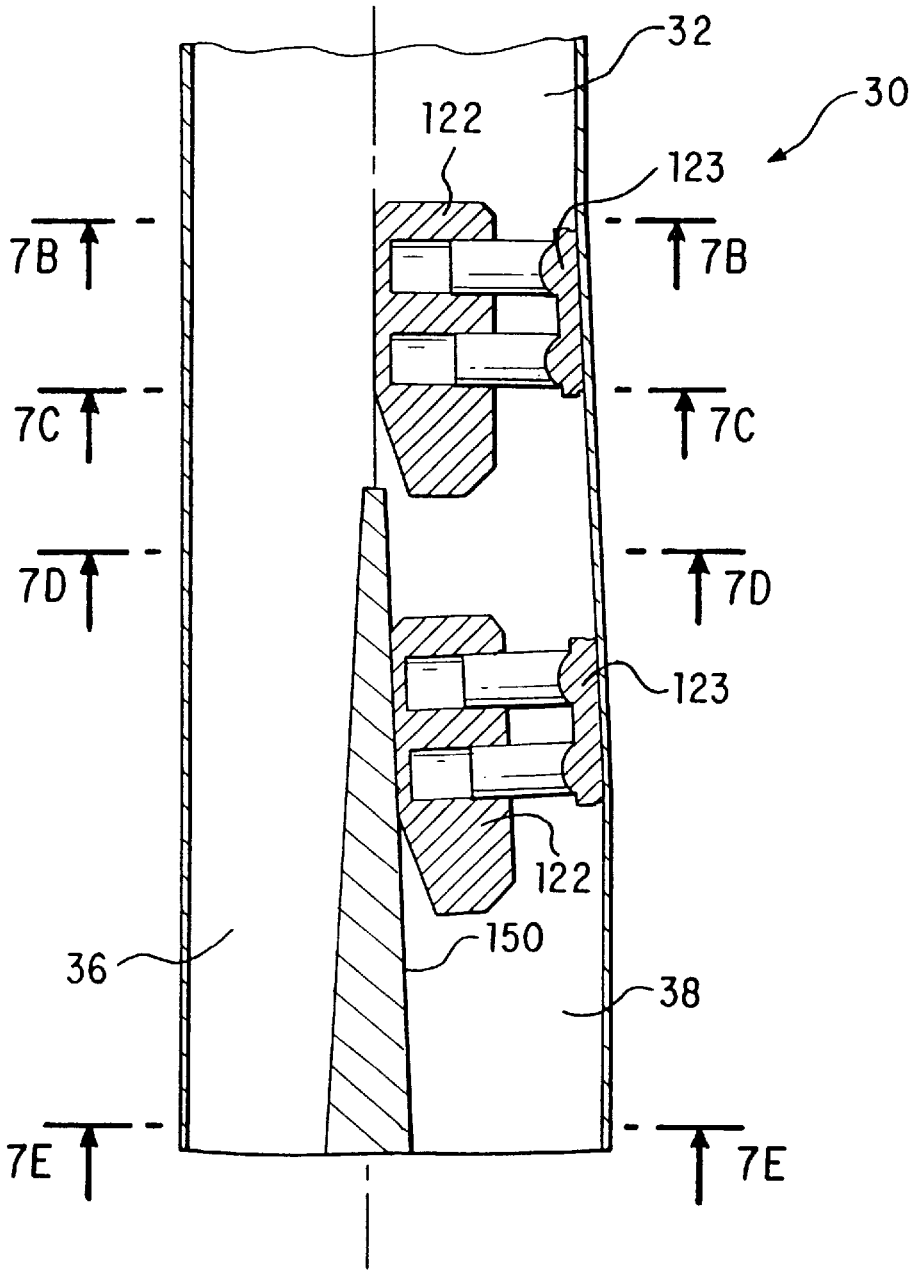
FIGS. 7A–7E illustrate stages of expanding the outlet members of an expandable branching sub according to the invention, with FIG. 7A illustrating an axial cross-section of the sub showing multiple branching outlets with one such outlet in a retracted position and the other such outlet being expanded starting with its connection to the branching head and continuing expansion downwardly toward the lower opening of the branching outlets, with FIG. 7B illustrating a radial cross-section at axial position B of FIG. 7A and assuming that each of three symmetrical branching outlets are being expanded simultaneously, and with FIGS. 7C through 7E showing various stages of expansion as a function of axial distance along the branching outlets.
Figure 7D:
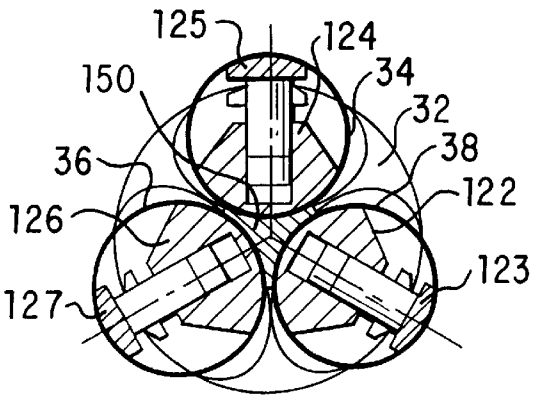
Figure 7E:
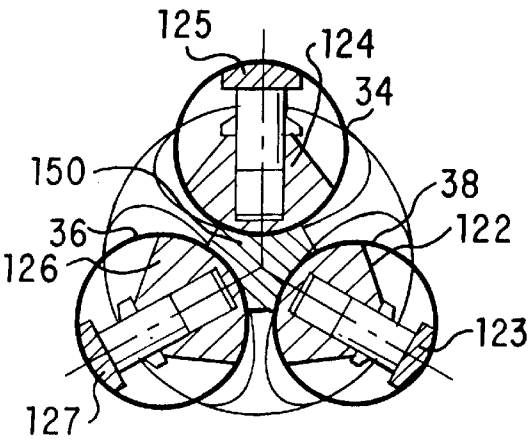
Figure 7B:
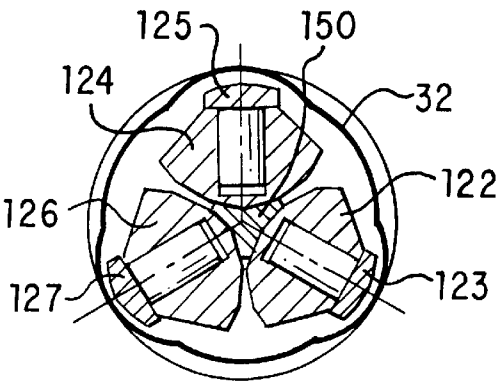
Figure 7C:
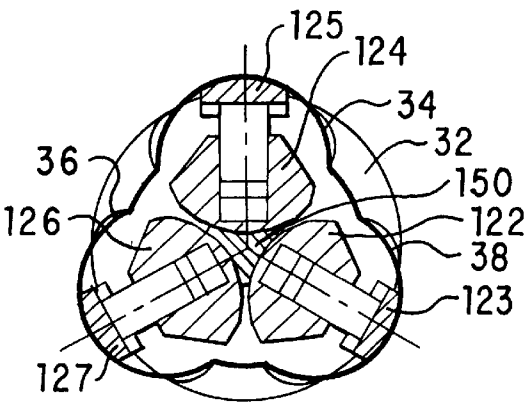

FIGS. 7A–7E illustrate downhole forming heads 122, 124, 126 operating at various depths in outlet members 38,34,36. As shown on the right hand side of FIG. 7A, a generalized forming head 122 is shown as it enters a deformed retracted outlet member, for example outlet member 38, at location B. Each of the forming heads 122, 124, 126 has not yet reached an outlet member, but the heads have already begun to expand the outlet wall of branching chamber 32 outwardly as illustrated in FIG. 7B. The forming heads 122, 124, 126 continue to expand the outlet members outwardly as shown at location C. FIG. 7C shows the forming heads 122, 124, 126 expanding the outlet members outwardly while simultaneously circularizing them. Forming pads 123, 125, 127 are forced outwardly by a piston in each of the forming heads 122, 124, 126. The forming heads simultaneously bear against central wall region 150 which acts as a reaction body so as to simultaneously expand and form the outlet members 38, 34, 36 while balancing reactive forces while expanding. FIGS. 7D and 7E illustrate the forming step at locations D and E of FIG. 7A.

Figure 8A:
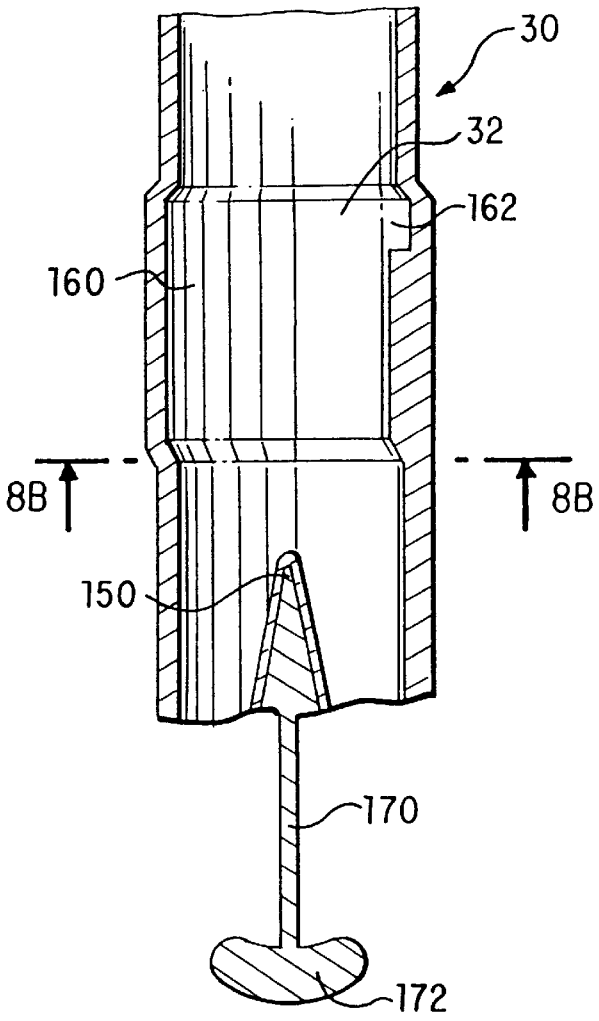
FIGS. 8A and 8B illustrate respectively in axial cross-section and a radial cross-section along lines 8B—8B, latching and orientation profiles of a branching chamber of the branching sub, and FIG. 8A further illustrates an extension leg and supporting shoe for deployment in a parent well and for providing stability to the branching sub while expanding the branching outlets from their retracted position.
Figure 8B:
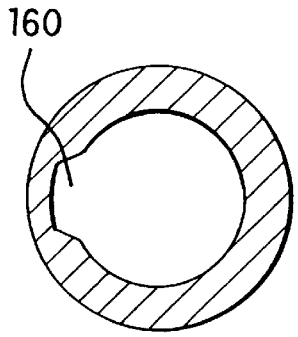

FIGS. 8A and 8B illustrate an axially extending slot 160 in the branching chamber 32 of branching sub 30. Such slot 160 cooperates with an orienting and latching sub of a downhole forming tool for radial positioning of such orienting and latching sub for forming and expanding the multiple outlet members downhole. A notch 162 in branching chamber 32 is used to latch the downhole forming tool at a predetermined axial position.

An extension leg 170 projects downwardly from the central wall region 150 of branching sub 30. A foot 172 is carried at the end of extension leg 170. In operation, foot 172 is lowered to the bottom of the borehole at the deployment location. It provides support to branching sub 30 during forming tool expanding and other operations.

Figure 9:
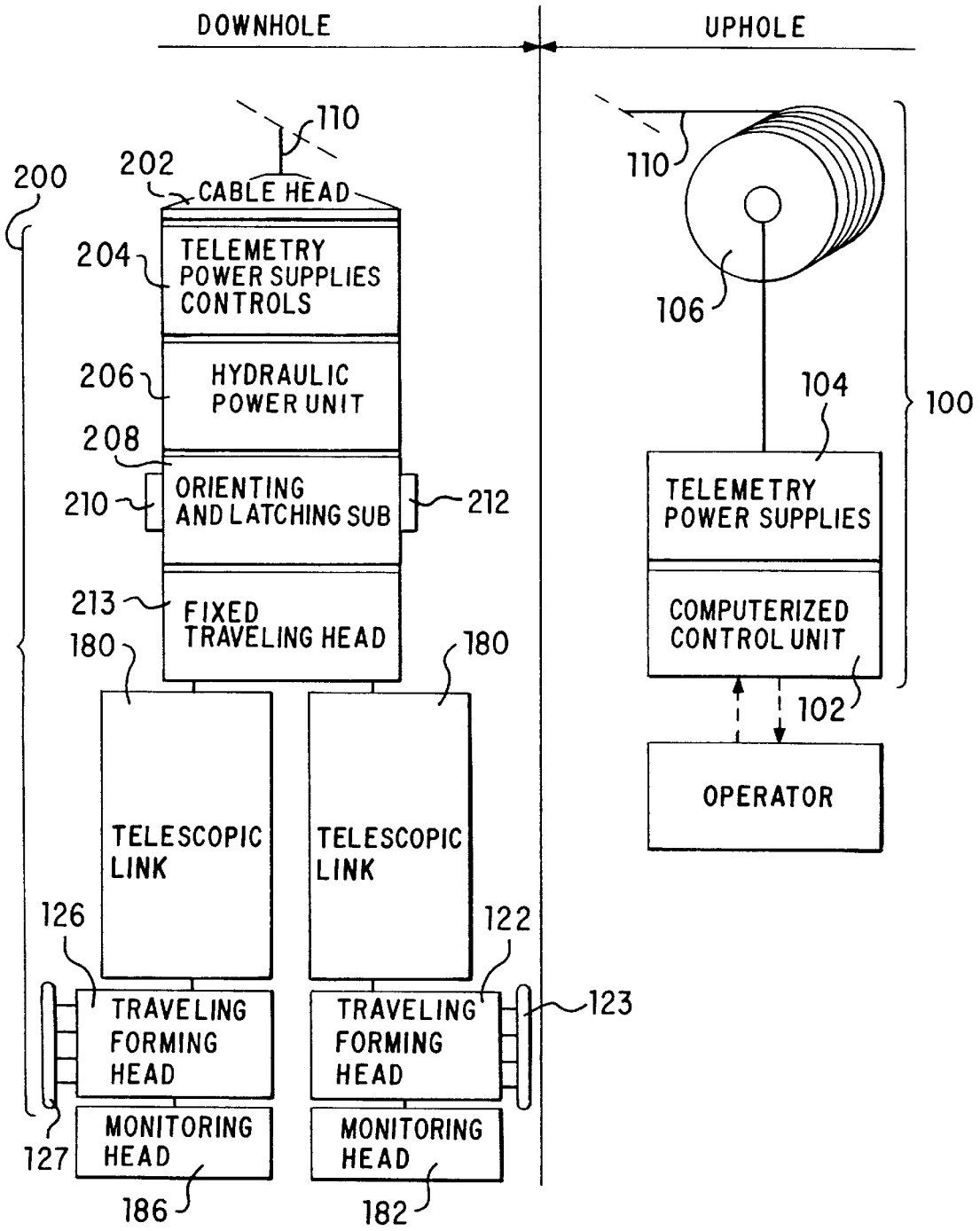
FIG. 9 schematically illustrates uphole and downhole apparatus for expanding the branching outlets of the branching sub.
Figure 10:
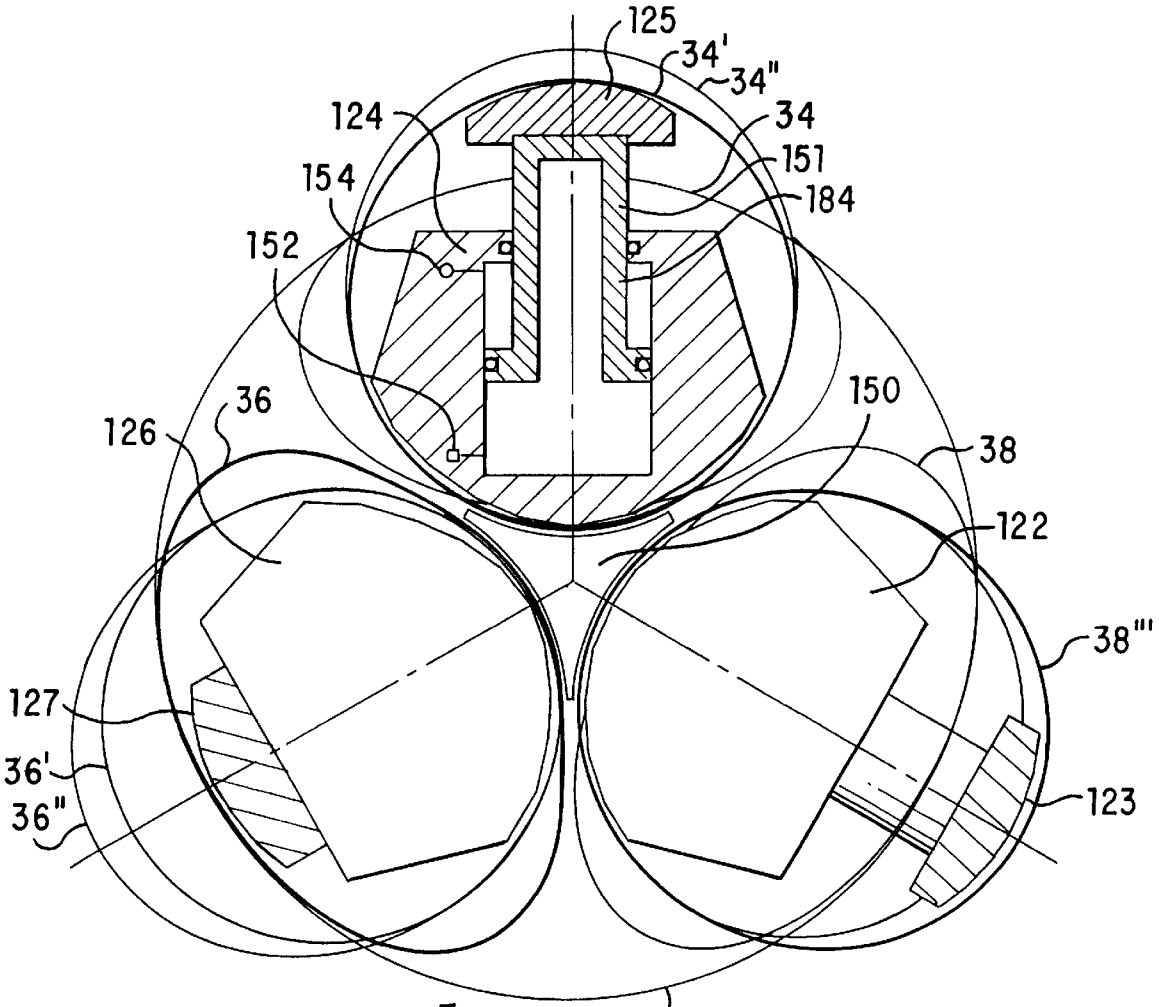
FIG. 10 illustrates steps of the process of expanding and forming the branching outlets with a pressure forming pad of the apparatus of FIG. 9.

Description of Forming Tool a) Description of Embodiment of FIGS. 9, 10

FIGS. 9 and 10 illustrate the forming tool used to expand multiple outlet members, for example outlet members 34, 36, 38 of FIGS. 3A, 3B, and 3C and FIGS. 7B, 7C, 7D and 7E. The forming tool includes uphole apparatus 100 and downhole apparatus 200. The uphole apparatus 100 includes a conventional computer 102 programmed to control telemetry and power supply unit 104 and to receive commands from and display information to a human operator. An uphole winch unit 106 has an electrical wireline 110 spooled thereon for lowering downhole apparatus 200 through a parent well casing and into the branching chamber 32 of a branching sub 30 which is connected to and carried at the end of the parent casing.

The downhole apparatus 200 includes a conventional cable head 202 which provides a strength/electrical connection to wireline 110. A telemetry, power supplies and controls module 204 includes conventional telemetry, power supply and control circuits which function to communicate with uphole computer 102 via wireline 110 and to provide power and control signals to downhole modules. Hydraulic power unit 206 includes a conventional electrically powered hydraulic pump for producing downhole pressurized hydraulic fluid. An orienting and latching sub 208 includes a latching device 210 (schematically illustrated) for fitting within notch 162 of branching chamber 32 of FIG. 8A and an orienting device 212 (schematically illustrated) for cooperating with slot 160 of branching chamber 32. When the downhole apparatus 200 is lowered into branching sub 30, orienting device 212 enters the slot 160 and the downhole apparatus 200 is further lowered until the latching device 210 enters and latches within notch 162.

Fixed traveling head 213 provides hydraulic fluid communication between hydraulic power unit 206 and the traveling forming heads 122, 124, 126, for example. Telescopic links 180 provide pressurized hydraulic fluid to traveling forming heads 122, 124, 126 as the heads 122, 124, 126 move downwardly within the multiple outlet members, for example outlet members 34, 36, 38 of FIGS. 7B–7E. Monitoring heads 182, 184, 186 are provided to determine the radial distance moved while radially forming an outlet member.

FIG. 10 illustrates traveling forming heads 126, 124, 122 in different stages of forming an outlet member of branching sub 30. Forming head 126 is shown in outlet member 36, which is illustrated by a heavy line before radial forming in the retracted outlet member 36. The outlet member is shown in light lines 36', 36", where the outlet member is depicted as 36' in an intermediate stage of forming and as 36" in its final formed stage.

The forming head 124 is shown as it is radially forming retracted outlet member 34 (in light line) to an intermediate stage 34+. A final stage is illustrated as circularized outlet member 34". The forming head 124, like the other two forming heads 126, 122, includes a piston 151 on which forming pad 125 is mounted. Piston 151 is forced outwardly by hydraulic fluid applied to opening hydraulic line 152 and is forced inwardly by hydraulic fluid applied to closing hydraulic line 154. A caliper sensor 184 is provided to determine the amount of radial travel of piston 151 and forming pad 125, for example. Suitable seals are provided between the piston 151 and the forming head 124.

The forming head 122 and forming pad 123 are illustrated in FIG. 10 to indicate that under certain circumstances the shape of the outlet member 38 may be Aover expanded≈to create a slightly oblong shaped outlet, such that when radial forming force from forming pad 123 and forming head 122 is removed, the outlet will spring back into a circular shape due to residual elasticity of the steel outlet member.

At the level of the branching chamber 32, forming heads 122, 124, 126, balance each other against the reaction forces while forcing the walls of the chamber outwardly. Accordingly the forming heads 122, 124, 126 are operated simultaneously, for example at level B of FIG. 7A, while forcing the lower end of the wall of the branching chamber 32 outwardly. When a forming head 122 enters an outlet member 38 for example, the pad reaction forces are evenly supported by the central wall region 150 of the branching chamber 32. The telescopic links 180 may be rotated a small amount so that the forming pads 127, 125, 123 can apply pressure to the right or left from the normal axis and thereby improve the roundness or circularity of the outlet members. After a forming sequence is performed, for example at location D in FIG. 7A, the pressure is released from piston 151, and the telescopic links 180 lower the forming heads 122, for example, down by one step. Then the pressure is raised again for forming the outlet members and so forth.

Figure 15B:
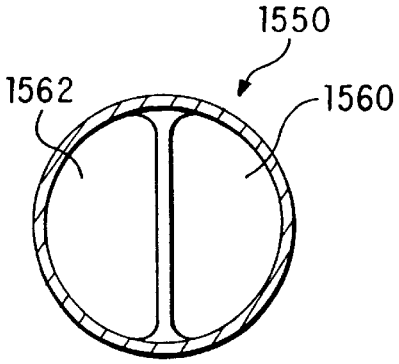
FIG. 15A illustrates a two outlet version of a branching sub according to the first embodiment of the invention, with FIGS. 15B, 15B', 15C, and 15D illustrating cross-sectional profiles of such two outlet version of a branching sub with an alternative post-forming tool at various depth locations in the outlet members.
Figure 15B:
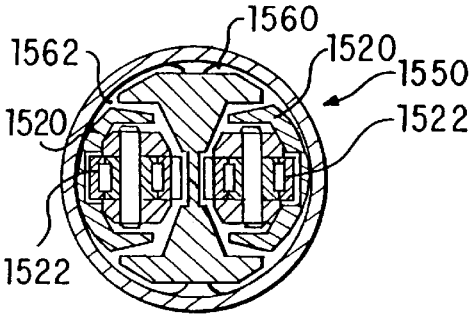
Figure 15C:
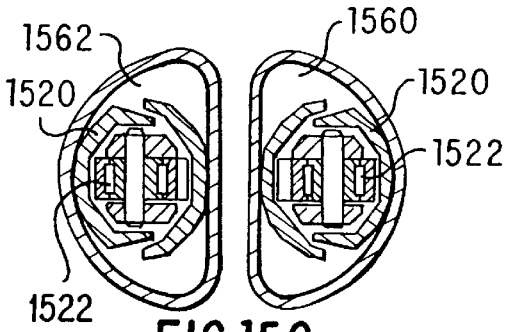
Figure 15D:
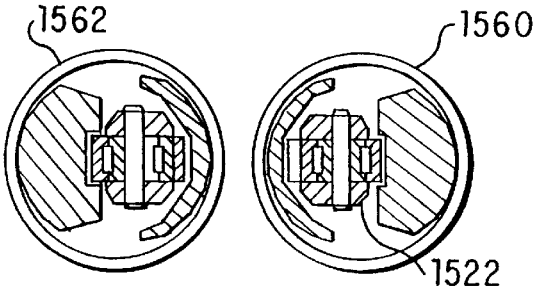
Figure 15A:
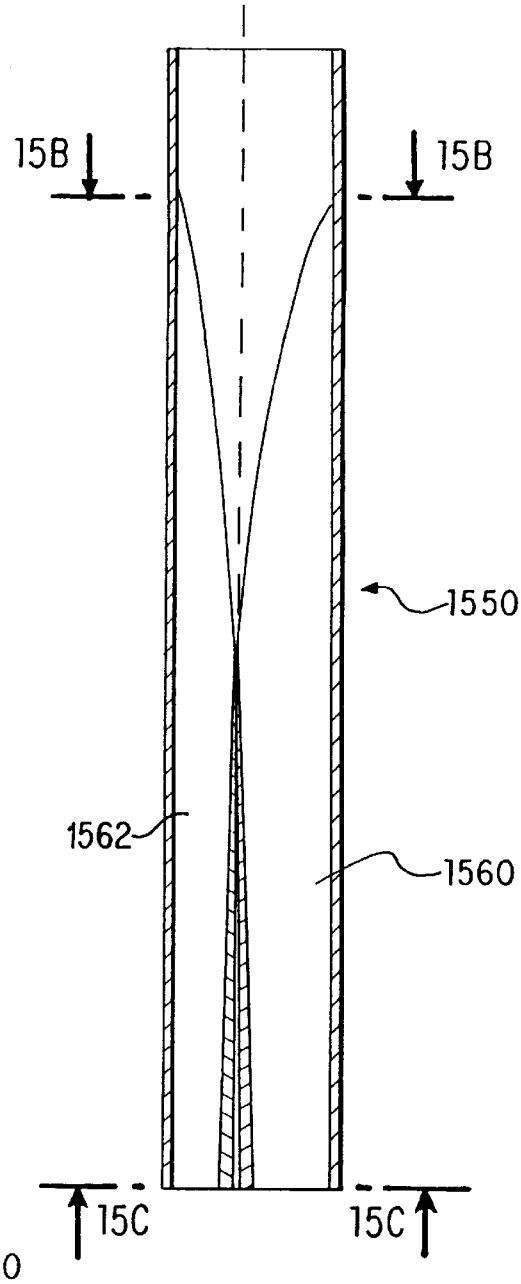
Figure 16:
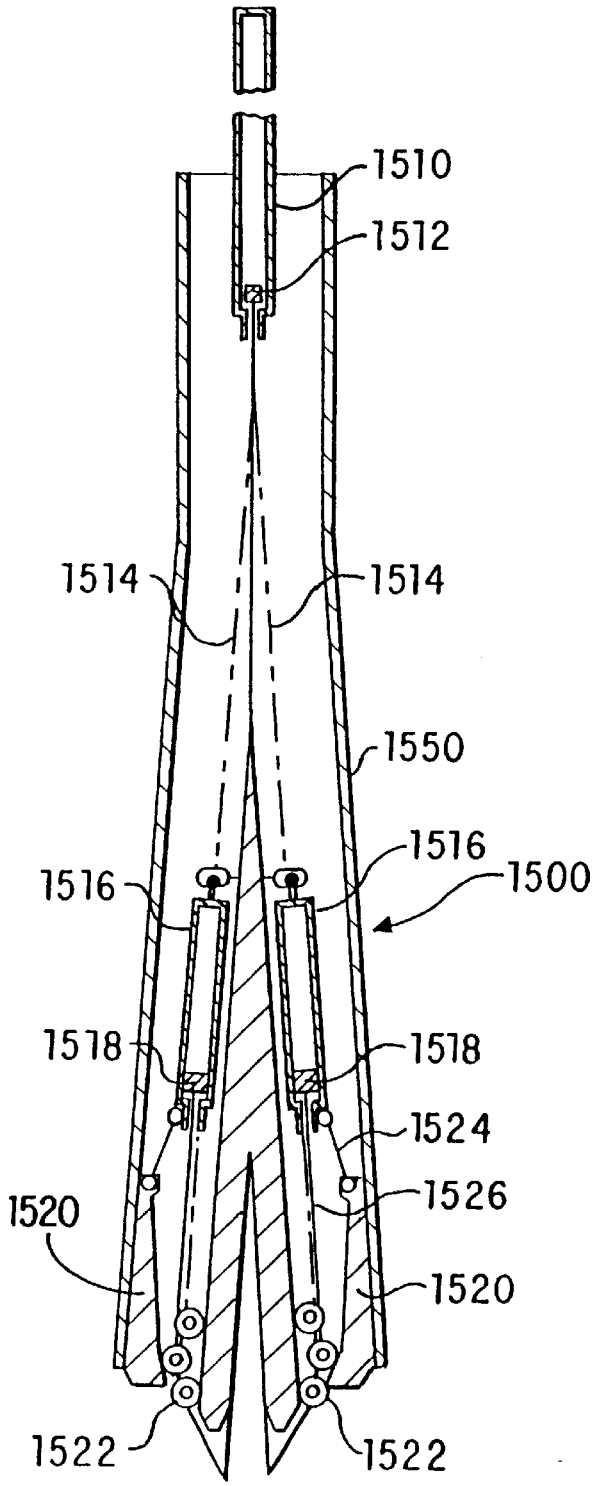
FIG. 16 illustrates a two arm alternative version of a post-forming tool.
Figure 17A:
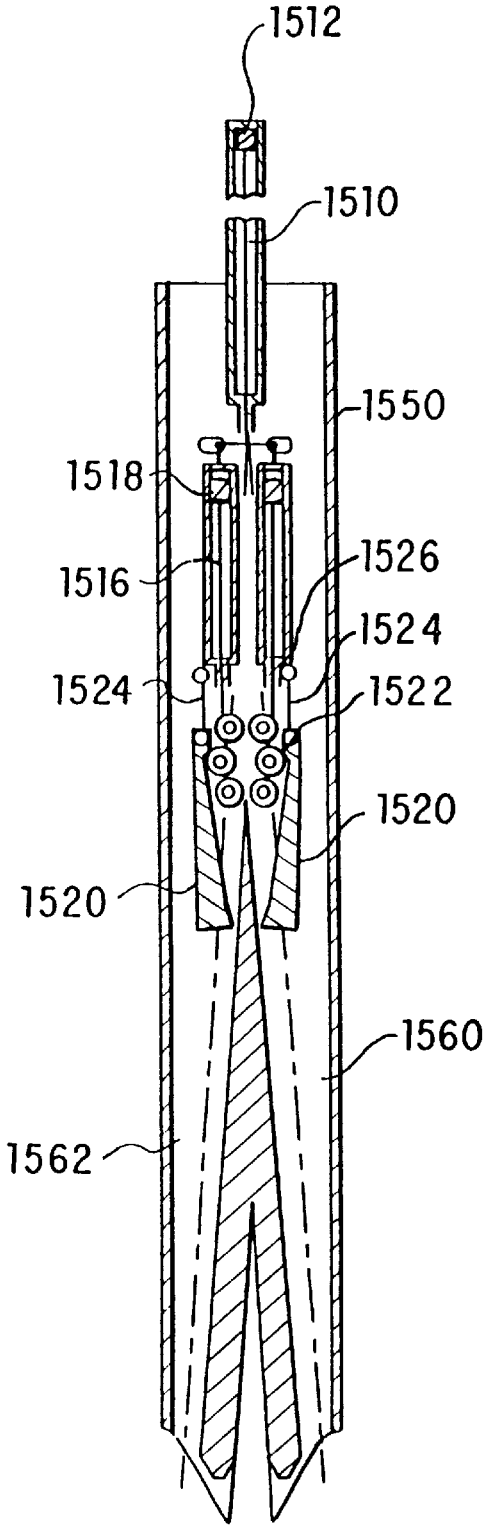
FIGS. 17A–17D illustrate the operation of such alternative post-forming tool.
Figure 17B:
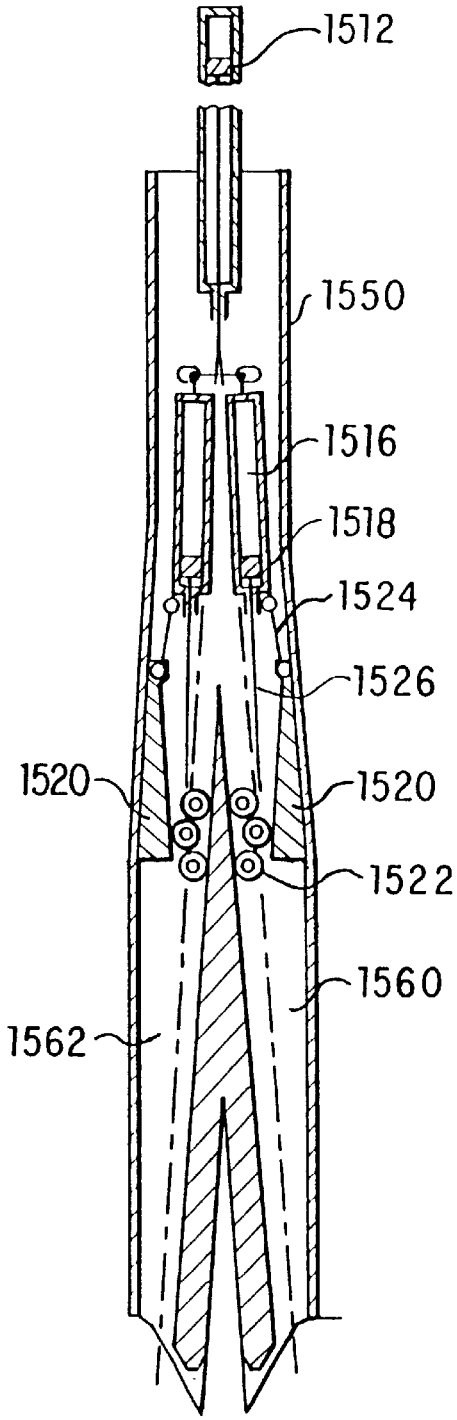
Figure 17C:
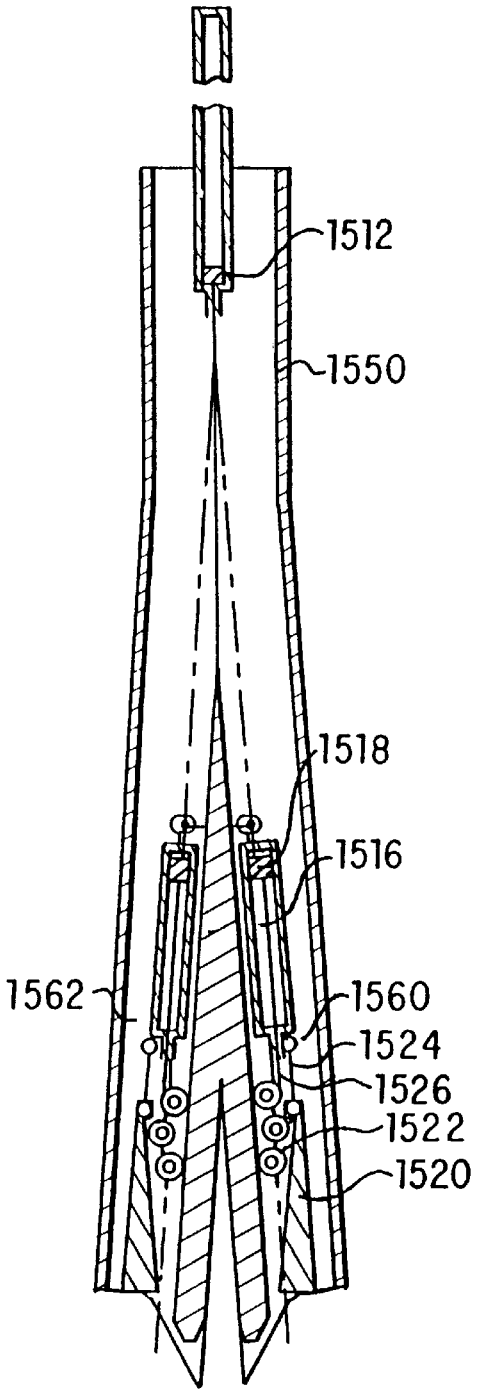
Figure 17D:
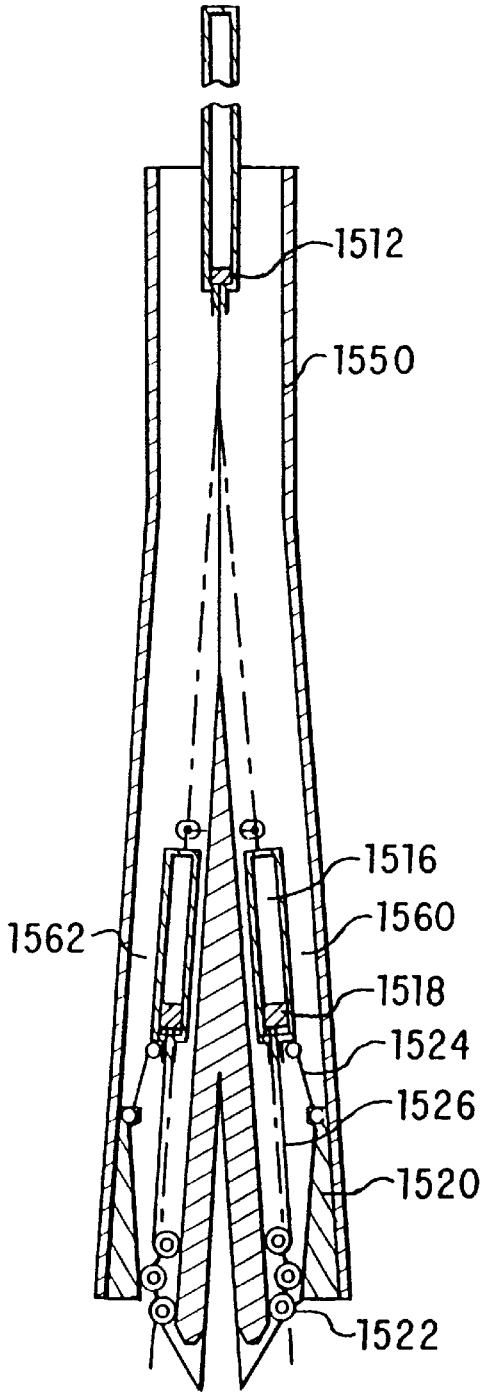

The composition of the materials of which the branching sub 30 is constructed is preferably of an alloy steel with austenitic structure, such as manganese steel, or nickel alloys such as AMonel≈ and Ahnconelk≈series. Such materials provide substantial plastic deformation with cold forming thereby providing strengthening.

b) Description of Alternative Embodiment of FIGS. 15A–15D, 16 and 17A–17D An alternative post-forming tool is illustrated in FIGS. 15A, 15B, 15BN, 15C, 15D, 16, and 17A–17D. The post-forming tool 1500 is supported by common downhole components of FIG. 9 including a cable head 202, telemetry, power supplies and controls module 204, hydraulic power unit 206 and an orienting and latching sub 208. FIG. 16 illustrates that post-forming tool 1500 includes a travel actuator 1510. A piston 1512 of travel actuator 1510 moves from an upper retracted position as shown in FIG. 17A to a lower extended position as shown in FIGS. 17C and 17D. FIG. 17B shows the piston 1512 in an intermediate position. Piston 1512 moves to intermediate positions depending on the desired travel positions of forming heads in the outlet members.

FIGS. 16 and 17D illustrate a two forming head embodiment of the post-forming tool 1500 where two outlet members (e.g., see outlet members 1560 and 1562 of FIGS. 15A–15D) are illustrated. Three or more outlet members may be provided with a corresponding number of forming heads and actuators provided. Links 1514 connect the piston 1512 to actuator cylinders 1516. Accordingly, actuator cylinders 1516 are forced downwardly into outlet members 1560, 1562 as piston 1512 moves downwardly.

Actuator cylinders 1516 each include a hydraulically driven piston 1518 which receives pressurized hydraulic fluid from hydraulic power unit 206 (FIG. 9) via travel actuator 1510 and links 1514. The piston 1518 is in an upper position as illustrated in FIGS. 17A and 17C and in a lower position as illustrated in FIGS. 17B and 17D.

The actuator cylinders 1516 are pivotally linked via links 1524 to forming pads 1520. The pistons 1518 are linked via rods 1526 to expanding rollers 1522. As shown in FIGS. 17A and 15BN, the forming pads 1520 enter an opening of two retracted outlet members as illustrated in FIG. 15B. The expanding rollers 1522 and forming pads 1520 are in a retracted position within retracted outlet members 1560, 1562.

The piston 1512 is stroked downwardly a small amount to move actuator cylinders 1516 downwardly a small amount. Next, pistons 1518 are stroked downwardly causing expanding rollers 1522 to move along the inclined interior face of forming pads 1520 causing the pads to push outwardly against the interior walls of retracted outlet members 1560, 1562 until the outlet members achieve a circular shape at that level. Simultaneously, the outlet members are forced outwardly from the axis of the multiple outlet sub 1550. Next, the pistons 1518 are stroked upwardly, thereby returning the expanding rollers 1522 to the positions as shown in FIG. 15C. The piston 1512 is stroked another small distance downwardly thereby moving the forming pads 1520 further down into the outlet members 1560, 1562. Again, the pistons 1518 are stroked downwardly to further expand the outlet members 1560, 1562 outwardly and to circularize the outlets. The process is continued until the positions of FIGS. 15D and 17D are reached which illustrate the position of the forming pads 1520 and actuator cylinders 1516 at the distal end of the multiple outlet members 1560, 1562.

Description of Method for Providing Branch Wells

FIGS. 11A–11H and FIG. 12 describe the process for establishing branch wells from a branching sub 30 in a well. The branching sub 30 is illustrated as having three outlet members 34, 36, 38 (per the example of FIGS. 3A, 3B, 3C and FIGS. 7A–7E) but any number of outlets may also be used as illustrated in FIGS. 6A–6E. Only the outlets 38, 36 are illustrated from the axial cross-sectional views presented, but of course a third outlet 34 exists for a three outlet example, but it is not visible in the views of FIGS. 11A–11H or FIG. 12.

Figure 11A:
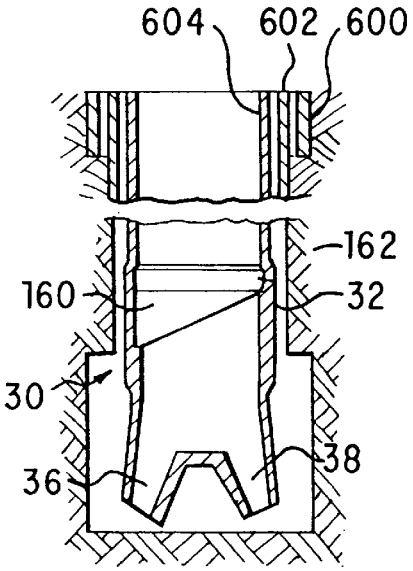
FIGS. 11A–11H illustrate steps of an installation sequence for a nodal branching sub and for creating branch wells from a parent well.

FIG. 11A shows that the branching sub 30 is first connected to the lower end of a parent casing 604 which is conveyed through intermediate casing 602 (if present). Intermediate casing 602 lines the wellbore and is typically run through surface casing 600. Surface casing 600 and intermediate casing 602 are typically provided to line the wellbore. The parent casing 604 may be hung from intermediate casing 602 or from the wellhead at the surface of the earth or on a production platform.

The outlet members 36, 38 (34 not shown) are in the retracted position. Slot 160 and notch 162 are provided in branching chamber 32 of branching sub 30 (see FIG. 12) to cooperate with orienting device 212 and latching device 210 of orienting and latching sub 208 of downhole apparatus 200 (See FIG. 9). When the parent casing 604 is set downhole, the branching sub 30 may be oriented by rotating the parent casing 604 or by rotating only the branching sub 30 where a swivel joint is installed (not illustrated) at the connection of the branching sub 30 with the parent well casing 604. The orienting process may be monitored and controlled by gyroscopic or inclinometer survey methods.

Description of Alternative Embodiment of FIGS. 18A–18F and 19A–19C

FIGS. 18A–18F illustrate concave deformation of outlet members in a retracted state of a branching sub according to an alternative embodiment of the invention. The outlets are shaped similar to that of a ruled surface shell. Concave deformation of retracted outlet members, under certain circumstances, provides advantages for particular outlet arrangements, especially for three or more outlet nodal junctions.

Figure 18A:
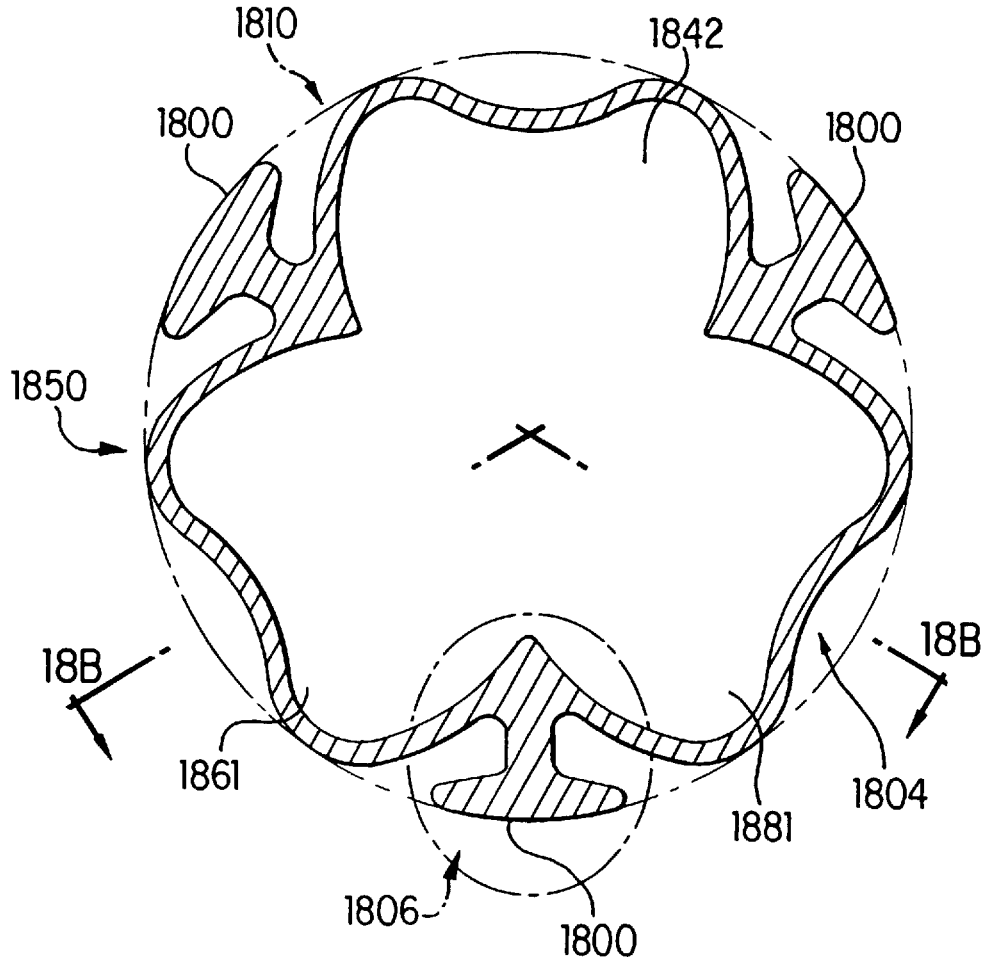
FIGS. 18A–18F illustrate a branching sub according to the first embodiment of the invention with concave deformation of the branching outlets.
Figure 18B:
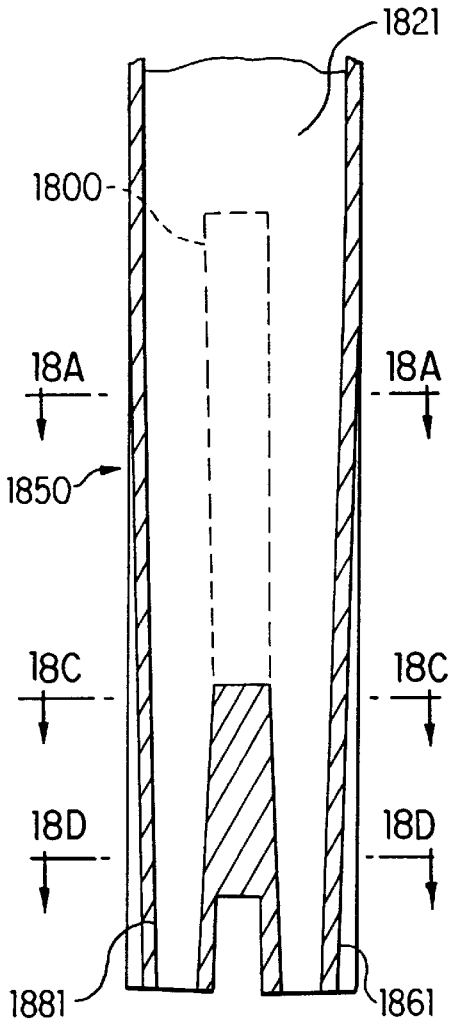

FIG. 18A illustrates, in a radial cross section through lines 18A of the branching chamber 1821, of the branching sub 1850 of FIG. 18B, that the outlets have a concave shape. Stiffening structure 1800 is provided at the juncture of each outlet member 1881, 1842, 1861 with its neighbor. As a result, the area that is capable of plastic deformation is reduced as the number of outlets increases. Providing the retracted shape of the outlet members, as in FIGS. 18A and 18B, allows minimization of the area to be deformed, and simultaneously respects the principle of deformation of a ruled surface shell that allows expansion by post-forming with a minimum of energy required. FIG. 18A illustrates an envelope 1810 of the overall diameter of the branching sub 1850 when the outlet members 1881, 1842, 1861 are retracted. The arrow 1806 points to a circled area of structural reinforcement. Arrow 1804 points to an area of concave deformation of the outlets in branching chamber 1821.

Figure 18F:
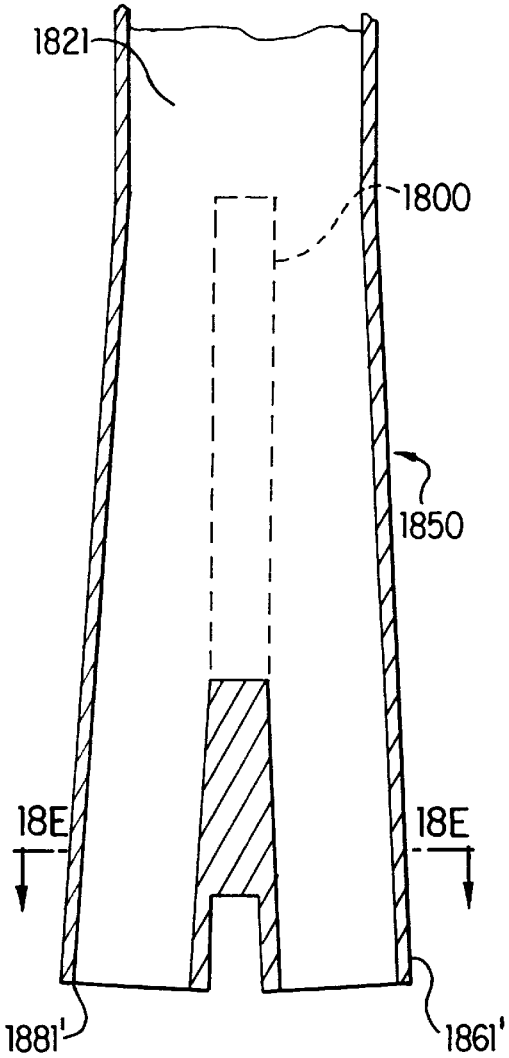
Figure 18C:
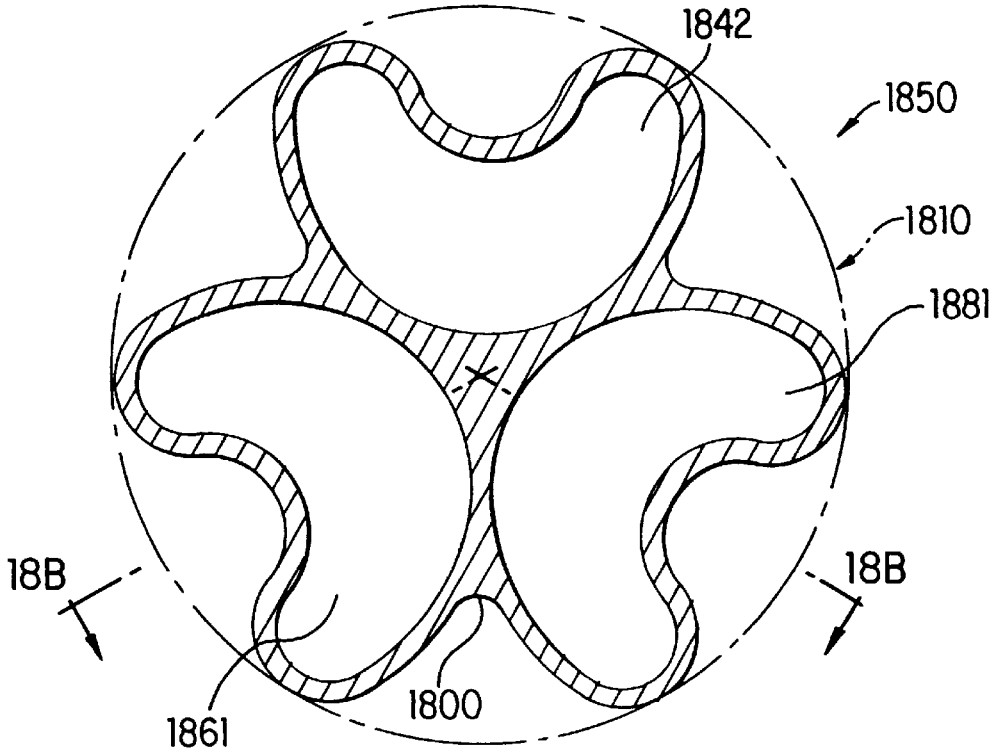
Figure 18D:
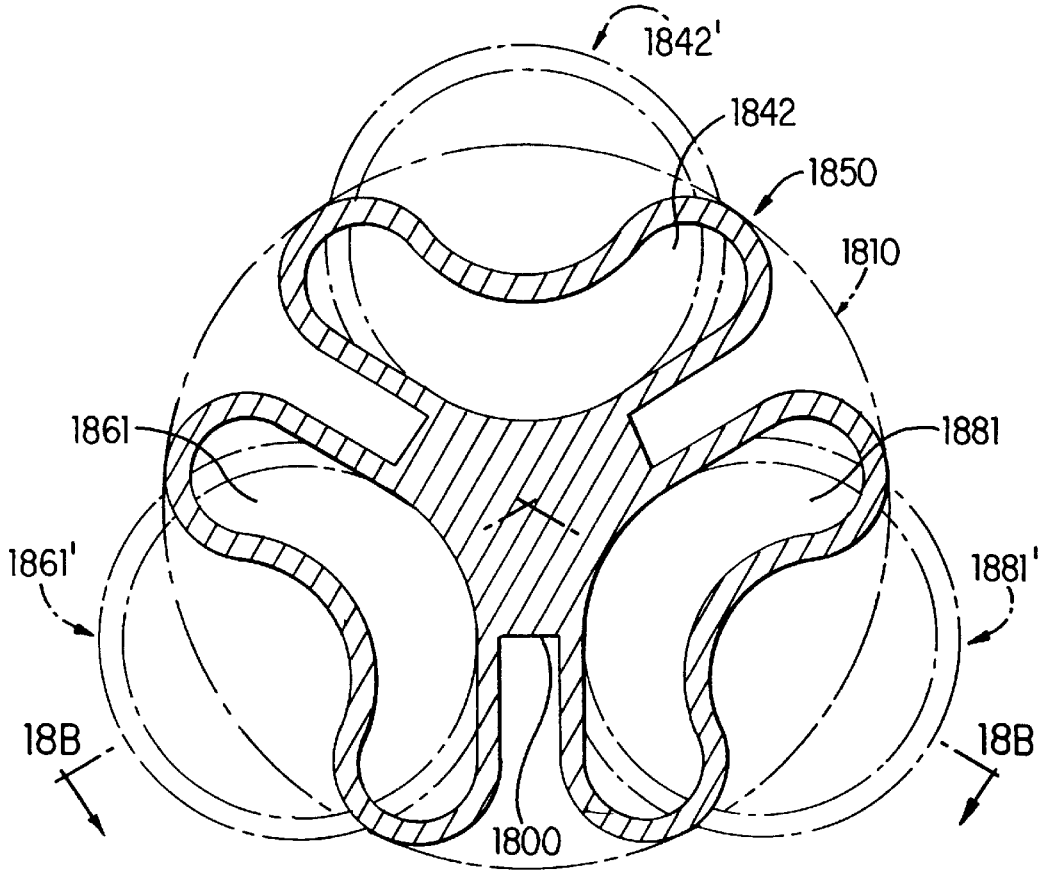

FIG. 18C illustrates the branching sub 1850 at a longitudinal position at the junction of the outlet members with a radial cross section through lines 18C of FIG. 18B. Arrow 1810 points to the outer envelope of the branching sub in its retracted state. FIG. 18D illustrates the branching sub 1850 near the end of the outlets while in a retracted state. Arrow 1810 points to the outer envelope of branching sub 1850 in the retracted state, while arrows 1881N, 1842N and 1861N point to dashed line outlines of the outlet members 1881, 1842 and 1861, respectively, after expansion.

Figure 18E:
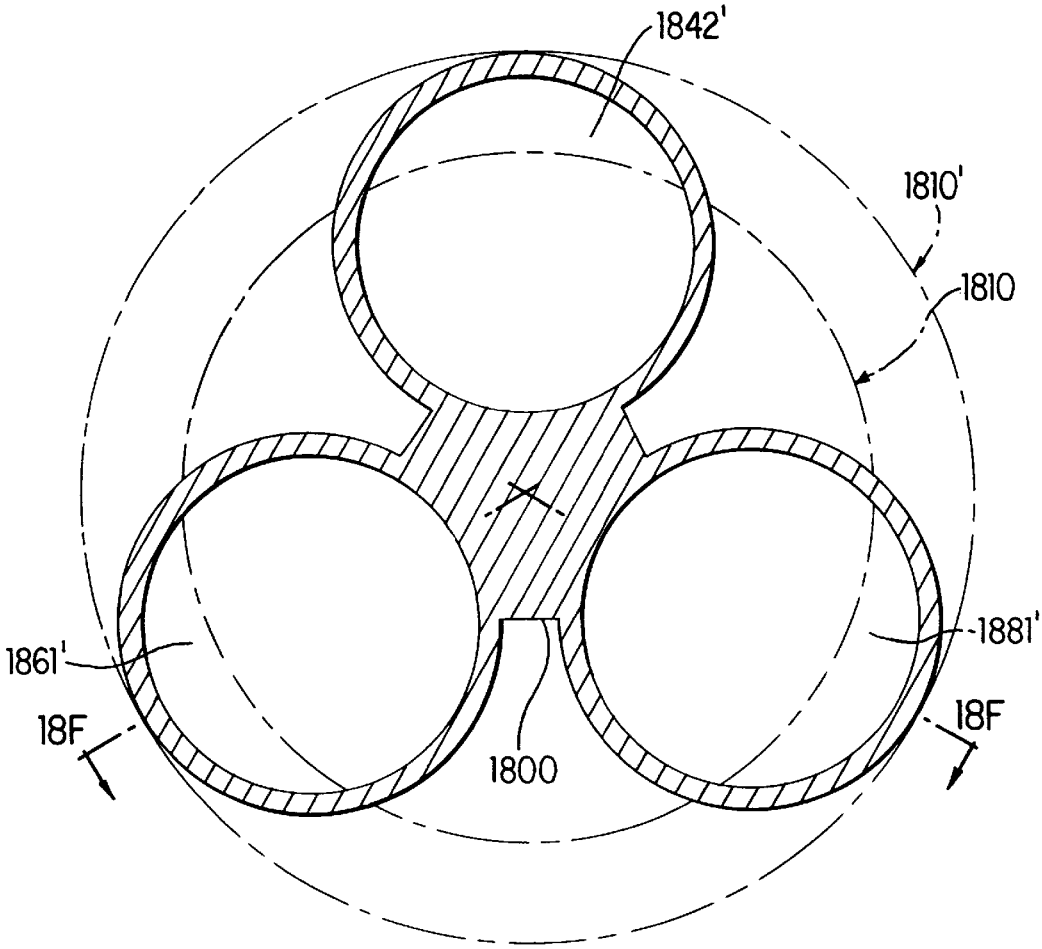

FIGS. 18E and 18F illustrate the branching sub 1850 in an expanded state where FIG. 18E is a radial cross section of through the outlet members at the end of the outlet. Arrow 1810 points to the outer envelope of the branching sub 1850 when in a retracted state; arrow 181ON points to the outer envelope when the outlet members 1881N, 1842N and 1861N have been expanded.

A preferred way of placing the outlet members 1881, 1842, 1861 into the retracted state of FIGS. 18A–18D is to construct the sub with the geometry of FIG. 18E and apply concave pliers along the vertical plan of axis symmetry of the junction. The deformation is progressively greater and deeper starting from the top of the outlet members (FIG. 18A) to the bottom of the outlet members. The entire junction of outlet members 1881, 1842, 1861 to branching chamber 1821 preferably includes welding of super plastic materials such as nickel-based alloys (Monel or Inconel, for example) in the deformed areas and materials of higher yield strength in the non-deformed part of the branching sub. Electron beam welding is a preferred method of welding the composite shell of the branching sub, because electron beam welding minimizes welding induced stresses and allows joining of sections of different compositions and thick walls with minimum loss of strength.

Figure 19A:
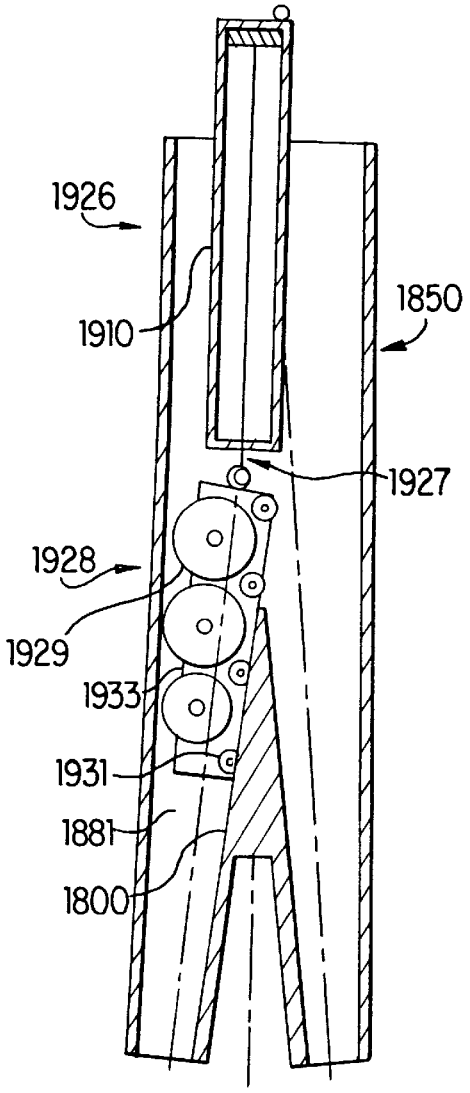
FIGS. 19A–19C illustrate an alternative actuating apparatus according to the invention.
Figure 19B:
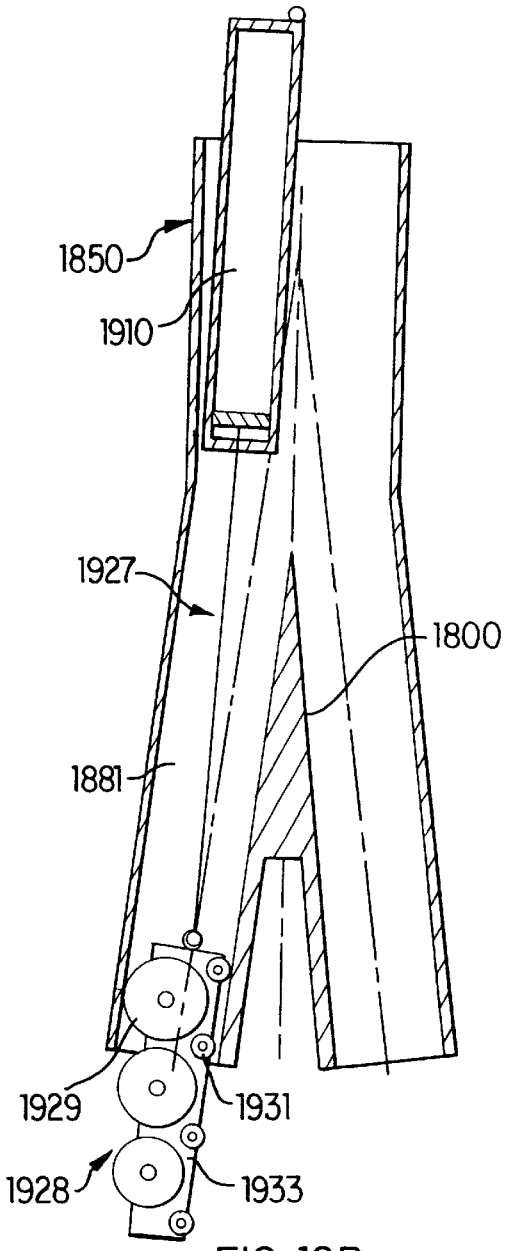
Figure 19C:
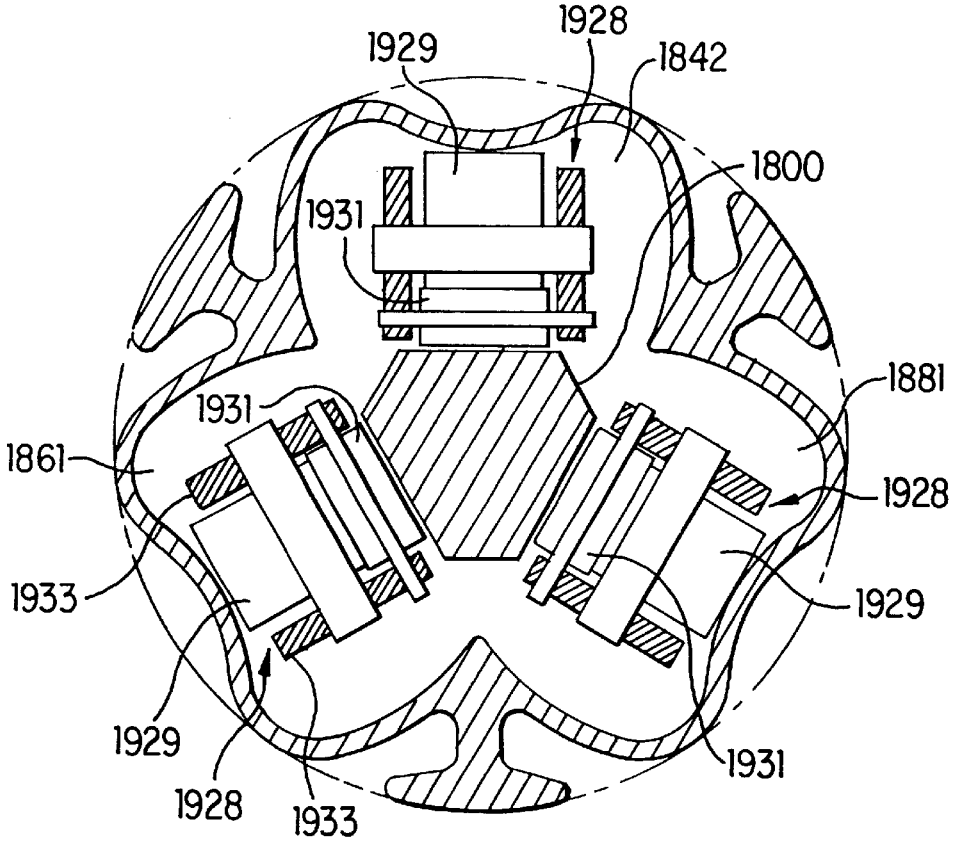

FIGS. 19A, 19B and 19C illustrate a post-forming tool 1926 similar to the post-forming tool of FIGS. 15BN–15D and 16 described above. An actuator sonde (not shown) supports the post-forming tool 1926 including actuator 1910, push rod 1927, and forming rollers 1929. FIG. 19A shows an axial section schematic of the post-forming tool 1926 operating in one outlet member 1881 of branching sub 1850 when it begins to expand such outlet member. FIG. 19B illustrates a similar axial section where actuator 1910 has been stroked outwardly to force push rod 1927 and traveling forming head 1928 downward, with forming rollers 1929 expanding outlet member 1881 outwardly while simultaneously rounding it. FIG. 19C shows a vertical cross section through the branching sub 1850 with a traveling forming head 1928 in each of the three outlet members 1881, 1842, 1861. Forming rollers 1929 force the concave portion of outlet members 1881, 1842 and 1861 outwardly while support rollers 1931 are supported against stiffening structure 1800. Push beams 1933 provide a frame for rotationally supporting forming rollers 1929 and support rollers 1931. Springs and linkages (not illustrated) are provided among push beams 1933, forming rollers 1929, and support rollers 1931 to insure that all moving parts retract to a top position so that the overall tool diameter collapses to the diameter of the branching chamber 1821 (FIG. 18B) of the branching sub 1850.

In operation, the traveling forming head 1928 of FIGS. 19A–19C follows a sequence of steps similar to that described above with respect to FIGS. 17A–17D. The post-forming tool 1926 is conveyed by means of a wireline and its associated sonde with cable head, telemetry power supplies and controls sub, hydraulic power unit, and orienting and latching sub, and is set so that the actuator 1910 seats above the top of the junction of stiffening structure 1800. The traveling forming head 1928, comprising push beams 1933 carrying forming rollers 1929 and support rollers 1931, is pushed downwardly by powering actuator 1910 so that the expansion of each outlet member (e.g., 1881, 1842, 1861) begins at its top end where it exits from the branching chamber 1821 and continues to the lower end of each outlet member. This sequence is repeated until the proper circular shape is achieved.

Figure 11B:
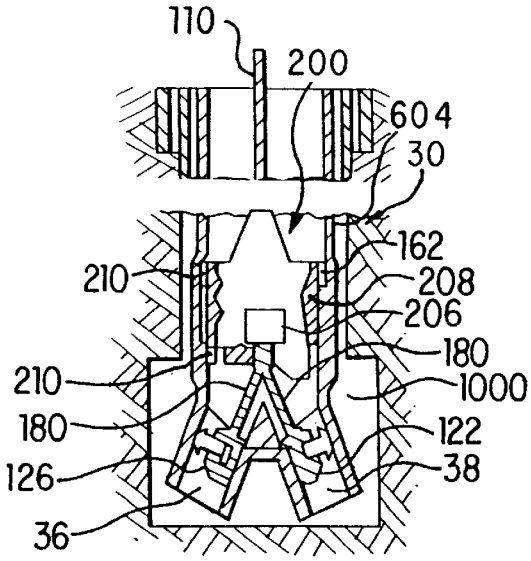

FIG. 11B illustrates the forming step described above with forming heads 122, 126 shown forming outlet members 38, 36 with hydraulic fluid being provided by telescopic links 180 from hydraulic power unit 206 and fixed traveling head 213. The outlet members 36, 38 are rounded to maximize the diameter of the branch wells and to cooperate by fitting with liner hangers or packers in the steps described below. The forming step of FIG. 11B also strengthens the outlet members 36, 38 by their being cold formed. As described above, the preferred material of the outlet members 36, 38 of the branching sub is alloyed steel with an austenitic structure, such as manganese steel, which provides substantial plastic deformation combined with high strengthening. Cold forming (plastic deformation) of a nickel alloy steel, such as Alnconel≈, thus increases the yield strength of the base material at the bottom end of the branching chamber 32 and in the outlet members 36, 38. The outlet members are formed into a final substantially circular radial cross-section by plastic deformation.

As described above, it is preferred under most conditions to convey and control the downhole forming apparatus 200 by means of wireline 110, but under certain conditions, e.g., under-balanced wellbore conditions, (or in a highly deviated or horizontal well) a coiled tubing equipped with a wireline may replace the wireline alone. As illustrated in FIG. 11B and described above, the downhole forming apparatus 200 is oriented, set and locked into the branching sub 30. Latching device 210 snaps into notch 162 as shown in FIG. 11B (see also FIG. 12). Hydraulic pressure generated by hydraulic power unit 206 is applied to pistons in forming heads 122, 126 that are supported by telescopic links 180. After a forming sequence has been performed, the pressure is released from the pistons, and the telescopic links 180 lower the forming pads down by one step. Then the pressure is raised again and so on until the forming step is completed with the outlet members circularized. After the outlet members are expanded, the downhole forming apparatus 200 is removed from the parent casing 604.

Figure 11C:
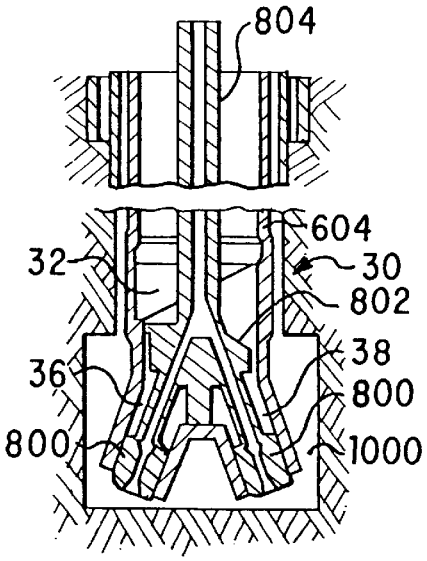
Figure 11D:
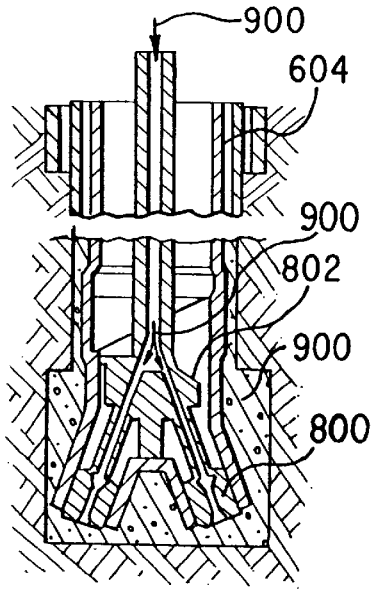
Figure 11E:
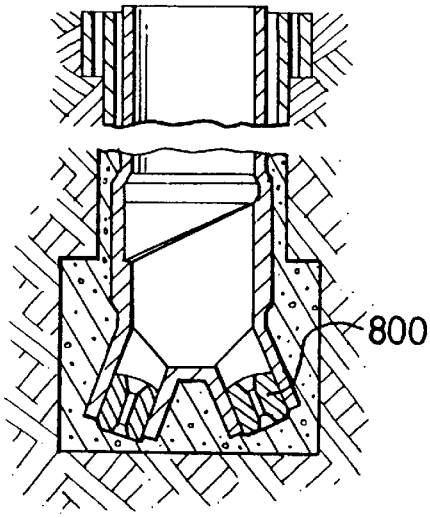

FIGS. 11C and 11D illustrate the cementing steps for connecting the parent casing 604 and the branching sub 30 into the well. Plugs or packers 800 are installed into the outlet members 36, 38. The preferred way to set the packers 800 is with a multiple head stinger 802 conveyed either by cementing string 804 or a coiled tubing (not illustrated). A multiple head stinger includes multiple heads each equipped with a cementing flow shoe. The stinger 802 is latched and oriented in the branching chamber 32 of branching sub 30 in a manner similar to that described above with respect to FIG. 11B. As illustrated in FIG. 11D, cement 900 is injected via the cementing string 804 into the packers 800, and after inflating the packers 800 flows through conventional check valves (not shown) into the annulus outside parent casing 604, including the bottom branching section 1000. Next, the cementing string 804 is pulled out of the hole after disconnecting and leaving packers 800 in place as shown in FIG. 11E.

Figure 11F:
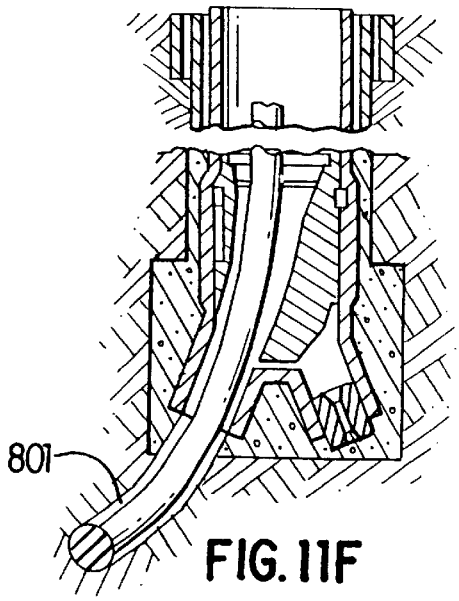
Figure 11G:
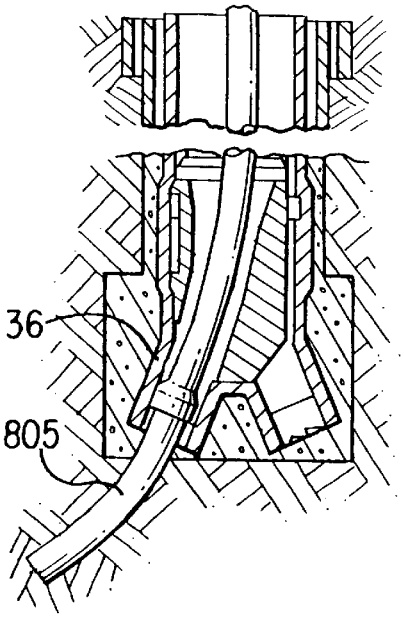
Figure 11H:
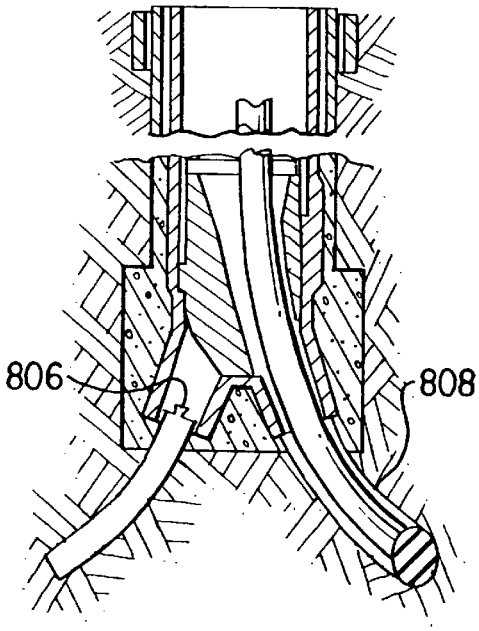

As shown in FIG. 11F, individual branch wells (e.g. 801) are selectively drilled using any suitable drilling technique. After a branch well has been drilled, a liner 805 is installed, connected, and sealed in the outlet member, 36 for example, with a conventional casing hanger 806 at the outlet of the branching sub 30 (See FIGS. 11G and 11H). The liner may be cemented (as illustrated in FIG. 11G) or it may be retrievable depending on the production or injection parameters, and a second branch well 808 may be drilled as illustrated in FIG. 11H.

Figure 12:
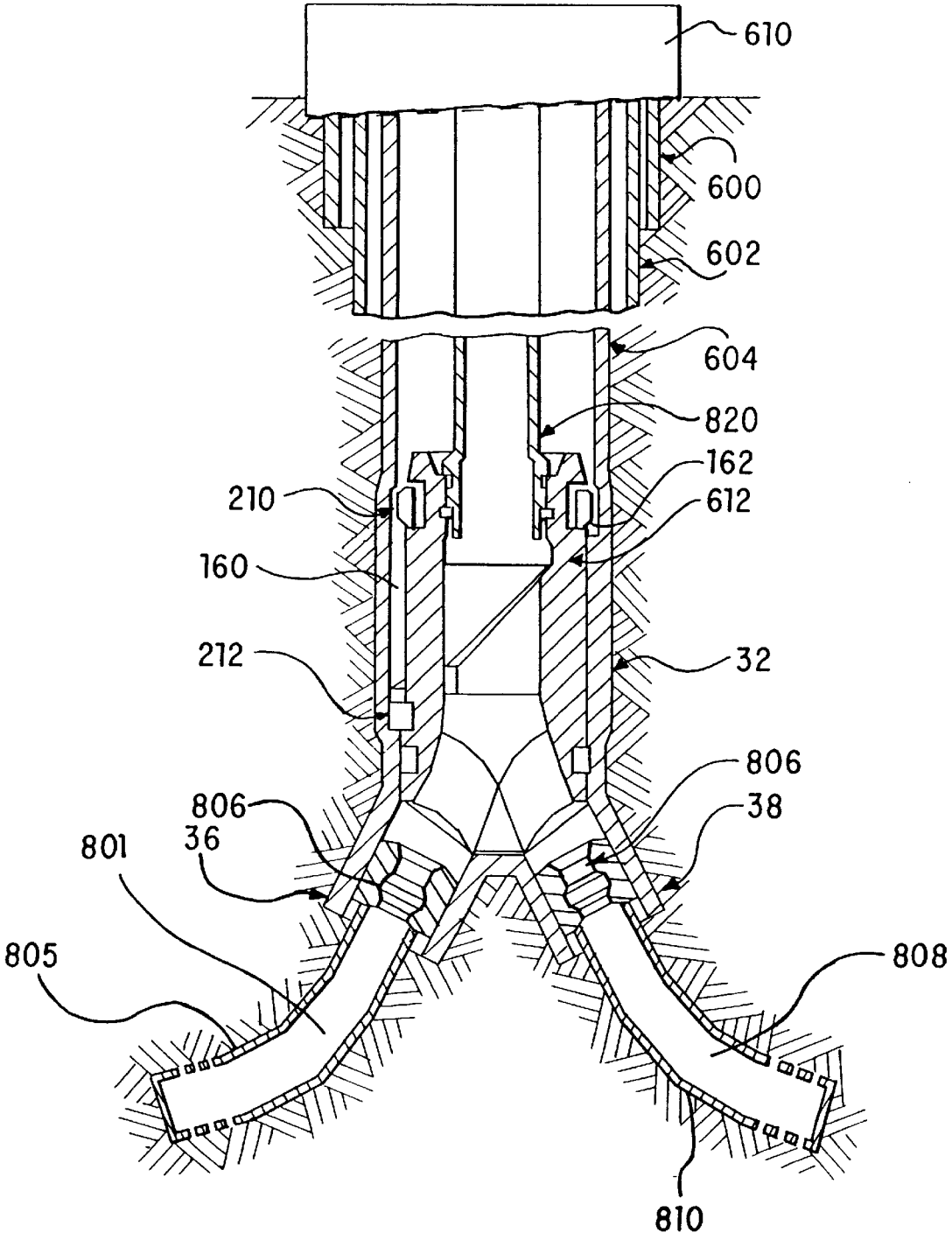
FIG. 12 illustrates a branching sub deployed in a parent well and further illustrates branch well liners hung from branching outlets and still further illustrates production apparatus deployed in the branching sub for controlling production from branch wells into the parent well.

FIG. 12 illustrates completion of branch wells from a branching sub at a node of a parent well having parent casing 604 run through intermediate casing 602 and surface casing 600 from wellhead 610. As mentioned above, parent casing 604 may be hung from intermediate casing 602 rather than from wellhead 610 as illustrated. The preferred method of completing the well is to connect the branch wells 801, 808 to a downhole manifold 612 set in the branching chamber 32 above the junction of the branch wells 801,808. The downhole manifold 612 is oriented and latched in branching chamber 32 in a manner similar to that of the downhole forming tool as illustrated in FIGS. 8A, 8B and 11B. The downhole manifold 612 allows for control of the production of each respective branch well and provides for selective re-entry of the branch wells 801, 808 with testing or maintenance equipment which may be conveyed through production tubing 820 from the surface.

In case of remedial work in the parent casing 604, the downhole manifold 612 can isolate the parent well from the branch wells 801, 808 by plugging the outlet of the downhole manifold 612. This is done by conveying a packer through production tubing 820, and setting it in the outlet of downhole manifold 612 before disconnecting and removing the production tubing 820. Valves controllable from the surface and testing equipment can also be placed in the downhole equipment. The downhole manifold 612 can also be connected to multiple completion tubing such that each branch well 801, 808 can be independently connected to the surface wellhead.

Figure 13A:
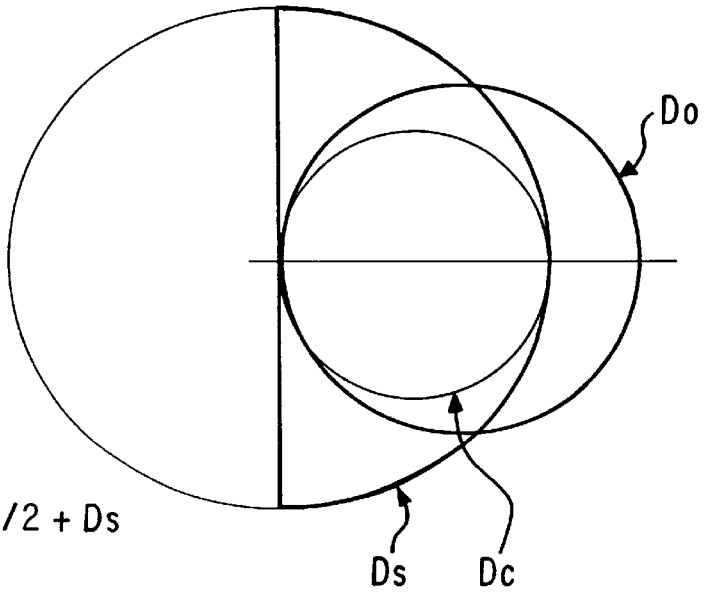
FIGS. 13A and 13B geometrically illustrate the increase in branch well size achievable for this invention as compared with prior art conventional axial branch wells from liners packed at the end of parent casing.
Figure 13B:
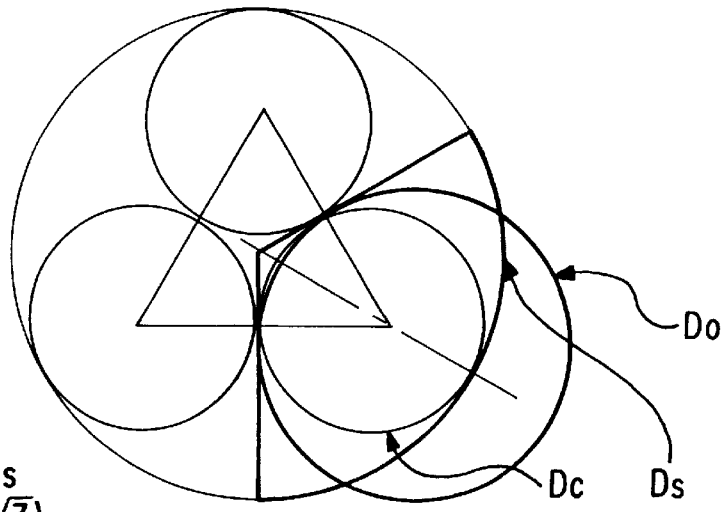

The use of a branching sub for branch well formation, as described above, for a triple branch well configuration, allows the use of dramatically smaller parent casing as compared to that required in the prior art arrangement of FIGS. 1A and 1B. The relationships between the branching sub diameter $D_s$, the maximum expanded outlet diameter $D_o$, and the maximum diameter of a conventional axial branch $D_c$ for a two outlet case is shown in FIG. 13A, and for a three outlet case in FIG. 13B. The same kind of analysis applies for other multiple outlet arrangements. In comparison to an equivalent axial branching that could be made of liners packed at the end of the parent casing, the branching well methods and apparatus of the present invention allow a gain in branch cross-sectional area ranging from 20 to 80 percent.

FIGS. 14A–14D illustrate various uses of two node branch well configurations according to the invention. FIGS. 14A and 14B illustrate a branching sub at a node according to the invention. FIG. 14C illustrates how branch wells may be used to drain a single strata or reservoir 1100, while FIG. 14D illustrates the use of a single node by which multiple branch wells are directed to different target zones 1120, 1140, 1160. Any branch well may be treated as a single well for any intervention, plugging, or abandonment, separate from the other wells.

Figure 20A:
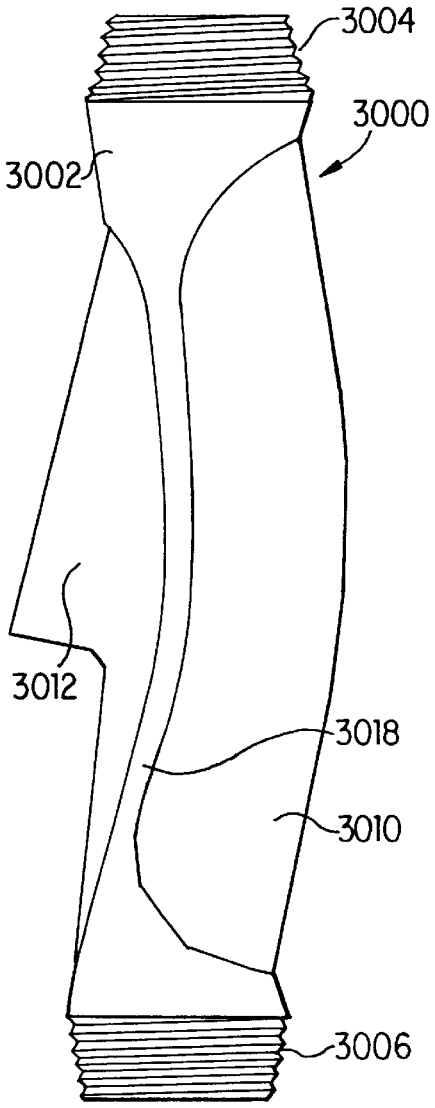
FIGS. 20A and 20B illustrate a second embodiment of the invention where
Figure 20B:
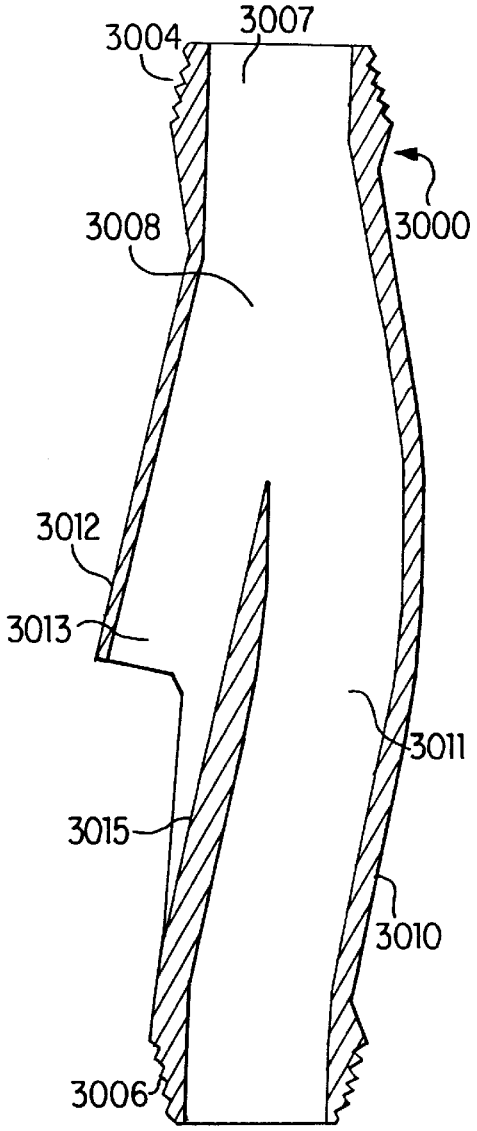

Description of Alternative Embodiment of a Branching Sub According to the Invention 1) Description of Alternative Branching Sub FIGS. 20A and 20B show an alternative embodiment 3000 of the invention of a branching sub. FIG. 20A shows an exterior view of the branching sub 3000 including a housing 3002 having threaded ends 3004, 3006. The branching sub 3000 of FIGS. 20A, 20B is illustrated in an expanded or post-formed state. The branching sub 3000 includes a main pipe 3010 which defines a feed through channel 3011 (see FIG. 20B) and at least one lateral branching outlet 3012 which defines a lateral channel 3013 (see FIG. 20B). A branching chamber 3008 is defined between the top channel 3007 and the feed through channel 3011 and lateral channel 3013. A bottom hole assembly (BHA) deflecting area 3015 separates main pipe 3010 from lateral branching outlet 3012.

In a retracted state, the branching sub 3000 may be placed in series with sections of well casing and positioned in a borehole with the running of the casing string into the borehole. After placement in the borehole, the housing of the branching sub 3000 is post-formed so that both the feed through channel 3011 and the lateral channel 3013 (or multiple branching outlets) are shaped to a final geometry which increases resistance to pressure and which maximizes the drift diameter of the lateral channel 3013 and the feed through channel 3011. Longitudinal ribs 3018 provide strength to the housing 3002 of the branching sub 3000. Longitudinal rib 3018 extends the entire axial length of the branching sub 3000 and is integral with the BHA deflecting area 3015 for a distance from the bottom threaded end 3006 of the branching sub 3000 to the branching chamber 3008.

Figure 21A:
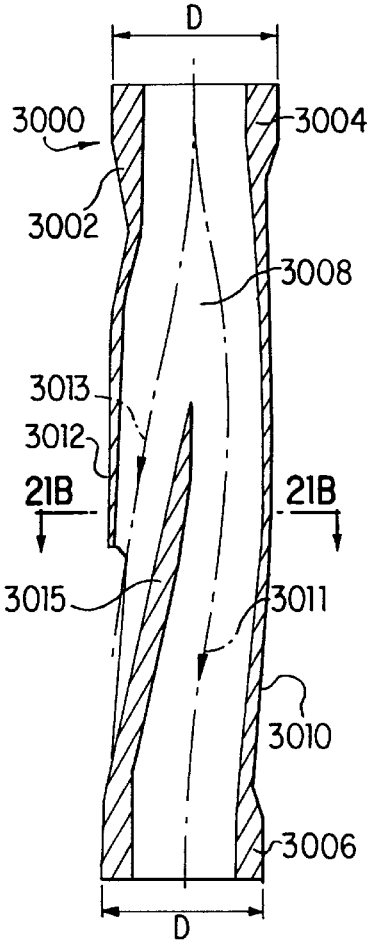
FIGS. 21A and 21B are axial and radial section views of the branching sub of FIGS. 20A and 20B but in a retracted state.
Figure 21C:
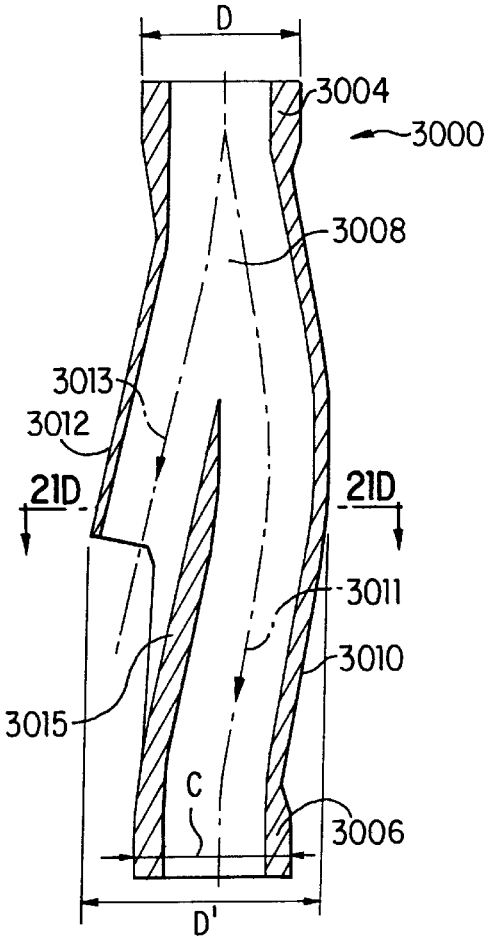
FIGS. 21C and 21D are axial and radial section views of the branching sub of FIGS. 20A and 20B in an expanded state.
Figure 21B:
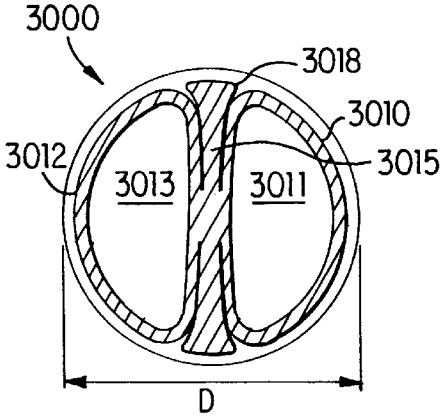
Figure 21D:
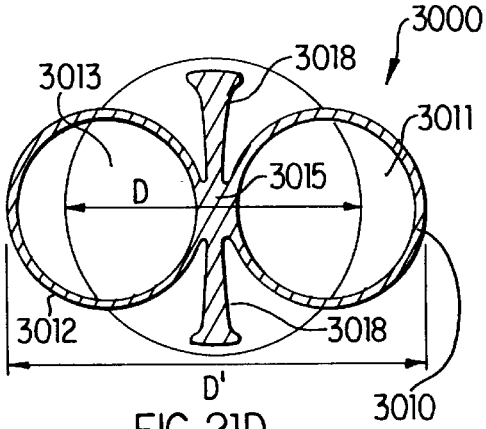

FIGS. 21A–21D schematically illustrate the branching sub 3000 in its retracted state (see FIGS. 21A, 21B) and in its expanded state (see FIGS. 21C, 21D). In the retracted state shown in FIGS. 21A, 21B, the main pipe 3010 and the branching outlet 3012 have been prefabricated so that the maximum outer diameter D of the branching sub 3000 is not greater than the top threaded end 3004 or bottom threaded end 3006. FIG. 21B, taken along section line 21B of FIG. 21A, illustrates the oblong shape of the feed through channel 3011 of main pipe 3010 and of the lateral channel 3013 of lateral branching outlet 3012. In the retracted state, branching sub 3000 can be placed between sections of borehole casing and run into an open borehole to a selected depth.

FIGS. 21C and 21D schematically illustrate the branching sub 3000 after it has had its feed through channel 3011 expanded and its lateral channel 3013 expanded. The maximum diameter in the expanded state, performed downhole, at section line 21D is D1 as compared to the diameter D of the top and bottom threaded ends 3004, 3006 of the branching sub 3000. FIG. 21D illustrates that the main pipe 3010 and the lateral branching outlet 3012 not only have been expanded outwardly from their retracted state of FIGS. 21A, 21B, but that they have been substantially circularized. Thus, in FIG. 21D, feed through channel 3011 and lateral channel 3013 are characterized by substantially circular internal diameters.

The downhole post-forming method and apparatus illustrated and described above by reference to FIGS. 7A–7E, 8A, 8B, 9 and 10 are used to expand the feed through channel 3011 and the lateral channel 3013.

Figure 22:
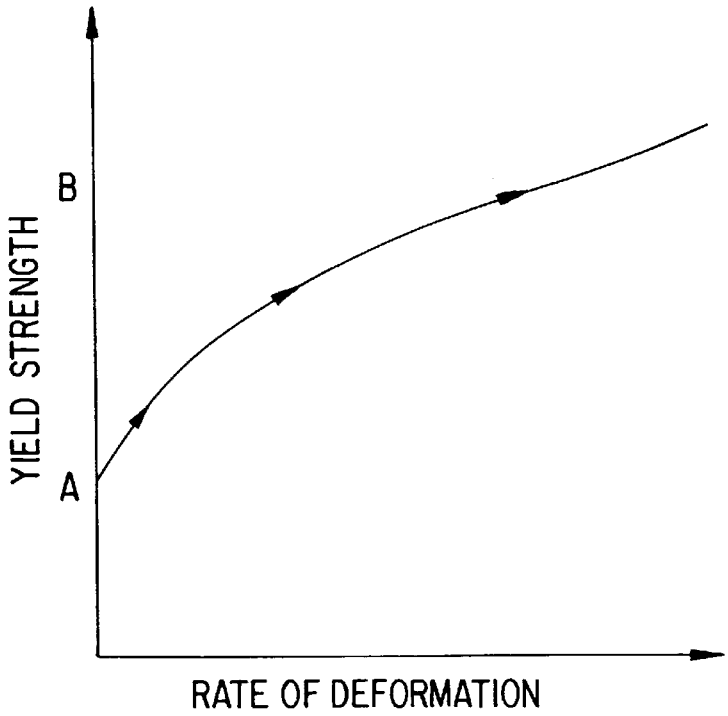
FIG. 22 is a graph which shows that the yield strength of the housing material of the branching sub increases with the rate of deformation during expansion.

The construction of branching sub 3000 is based on the combination of material and geometrical properties of the BHA deflecting area 3015. The material is specifically selected and treated to allow a large rate of deformation without cracks. The geometry of the wall is such that both its combined thickness and shape ensure a continuous and progressive rate of deformation during the expansion. The plastic deformation increases the yield strength by cold work effect and hence gives the joint an acceptable strength that is required to support the pressure and liner hanging forces. FIG. 22 shows that the yield strength after expansion increases with the rate of deformation of the outlets. A preferred material for use in the post-forming areas is a fine grain normalized carbon steel or an austenitic manganese alloyed steel that reacts favorably to cold working. A preferred construction method is to manufacture different specific components in order to optimize the material and forming process of each particular part. In a final stage, the components are welded together so that the housing 3002 becomes one single continuous structural shell.

2) Description of Use of Alternative Branching Sub

Figure 23:
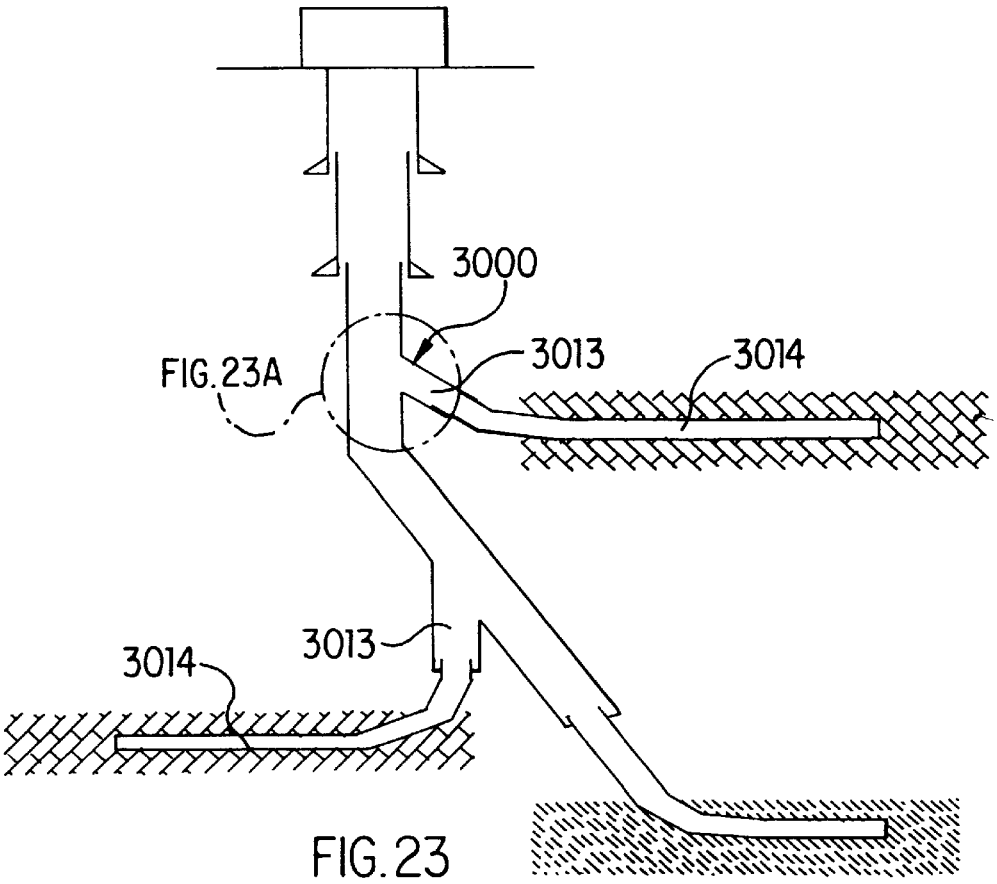
FIG. 23 is a schematic illustration of the branching sub according to a second embodiment of the invention where lateral or branch holes are created from the main body of the sub or subs to reach distinct formations from one main borehole.
Figure 23A:
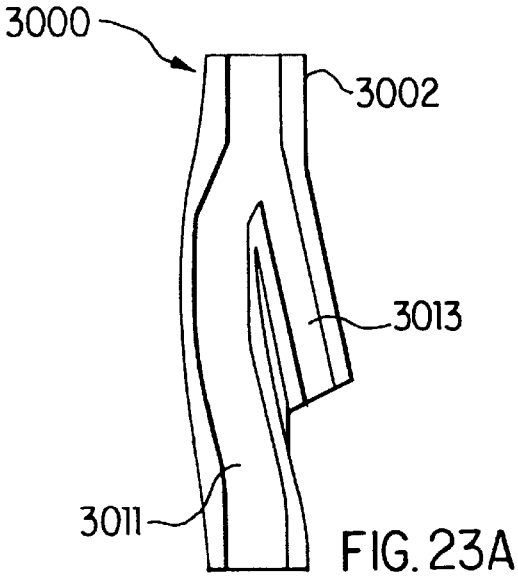
FIG. 23A shows a portion of the branching sub of FIG. 23.

FIG. 23 schematically illustrates the use of the alternative branching sub 3000 as described above. A preferred use of the branching sub 3000 is for providing multiple branches in a parent well. Such multiple branches may improve the drainage of a subterranean formation.

Before the invention of the branching sub 3000 of FIGS. 20A, 20B and 21A–21D, connection of a lateral branch to a parent well has generally made use of an arrangement of several parts with sealing of the branch well to the parent well with rubber, resin or cement. Such joints require a complex method of installation and present a risk of hydraulic isolation failure after several pressure cycles in the well.

The branching sub 3000 according to the invention allows for providing multiple branches from a parent casing with no sealing joint, but with conventional liner hanging packers and casing joints. The geometry of the housing 3002 of the branching sub 3000 allows the pressure rating of the sub and the size of the branch to be maximized with regard to the parent casing size. FIG. 23 shows an example of the use of a branching sub 3000 where, after expansion downhole, branch wells 3014 are provided to separate parts of the earth's crust by means of lateral channels 3013. The branch wells 3014 can be used for extraction, storage or injection of various fluids such as mono or poly-phasic fluids of hydrocarbon products, steam or water.

c) Description of Deflection Apparatus and Procedures

Figure 24:
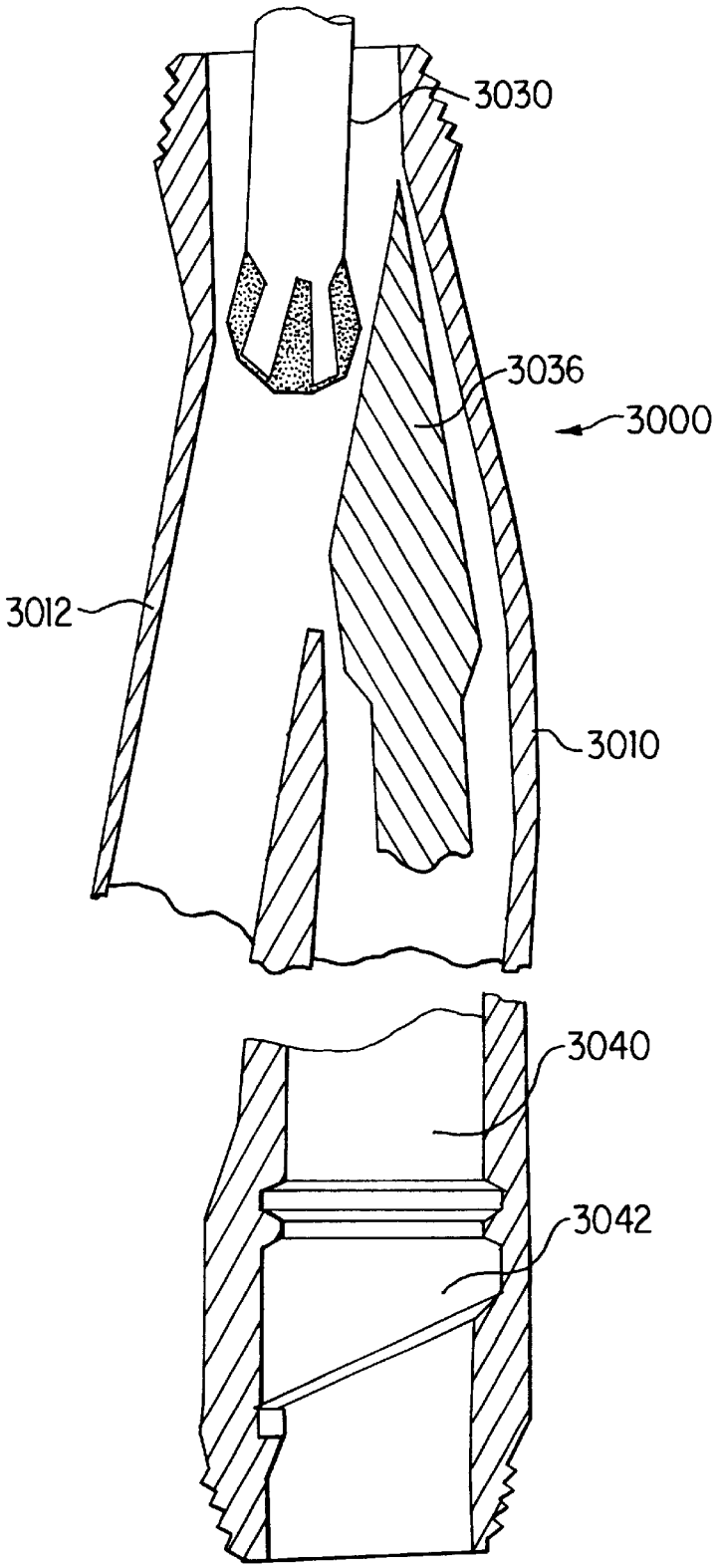
FIG. 24 illustrates the use of a deflecting tool which may be inserted within the main pipe of the branching sub whereby a drilling tool which enters from the top of the sub may be directed into the lateral outlet.

FIG. 24 illustrates how a drilling tool 3030 can be guided or deflected from main pipe 3010 into lateral branching outlet 3012 after the branching sub 3000 has been expanded downhole. A deflecting tool 3036 is set in main pipe 3010 by means of elements which cooperate with the positioning groove 3040 and orienting cam and slot 3042 illustrated schematically.

Figure 25:
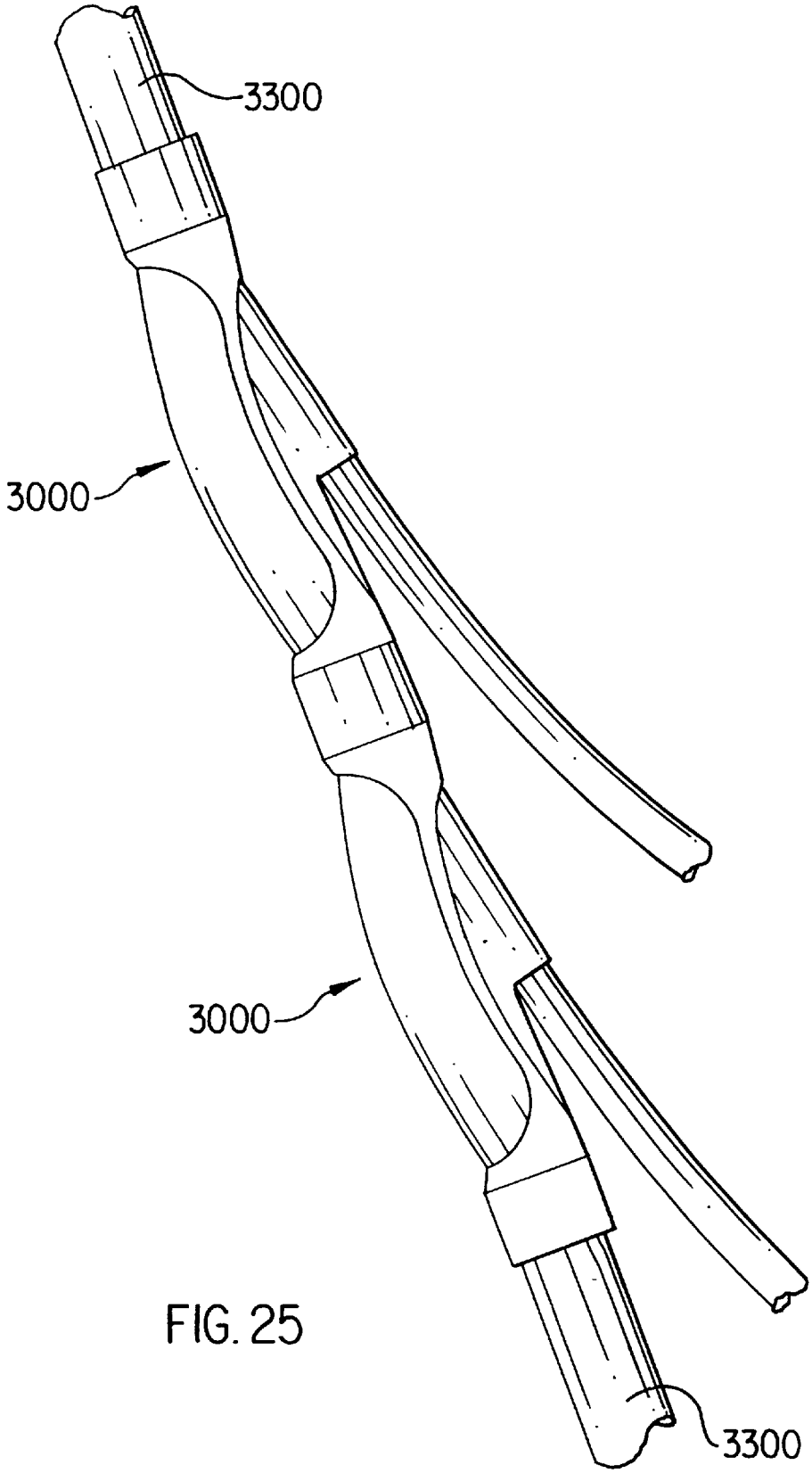
FIG. 25 illustrates two branching subs connected in tandem with the tandem connection placed in a series of casing links of a casing string.

Several lateral branching subs can be stacked in tandem at a location in the well or at several places along the casing string in order to provide optimal communication with various formations from the parent well. FIG. 25 illustrates two branching subs 3000 according to the alternative embodiment of the invention which are connected in tandem in a casing string 3300. Where two or more branching subs 3000 are connected in a casing string 3300, each sub can be oriented with the same or a different face angle for the lateral branches. As a consequence, different angular orientations from the parent well may be provided to reach a large volume of subterranean formations with different lateral branches. The casing string 3300 may be oriented vertically or horizontally, or it may be tilted; but the lateral branches may in any case extend laterally from the parent casing. Although departing at a narrow angle from the casing string 3300, lateral boreholes from the lateral outlets of branching subs 3000 can be directionally drilled to a vertical, deviated or horizontal orientation.

Figure 26B:
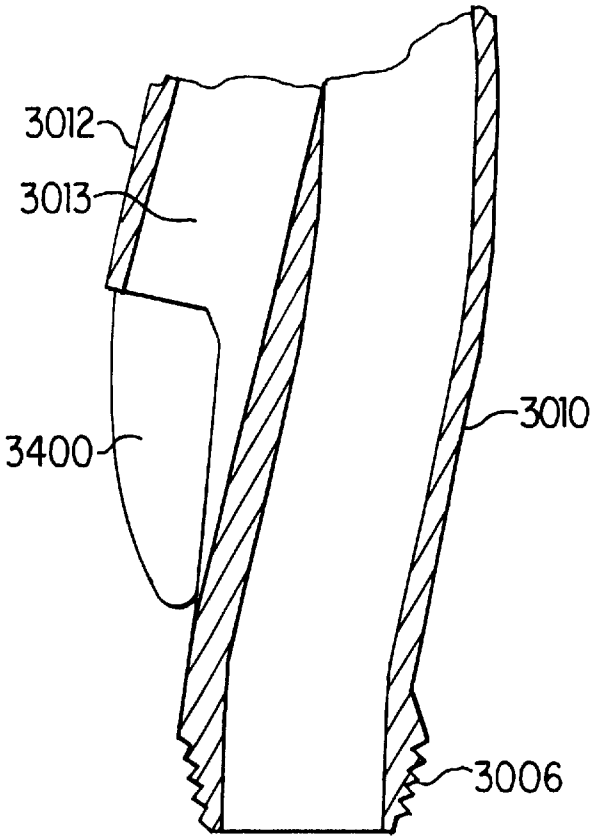
FIGS. 26A and 26B illustrate a cap which may be welded across the branching outlet in order to close it off for certain well operations.
Figure 26A:
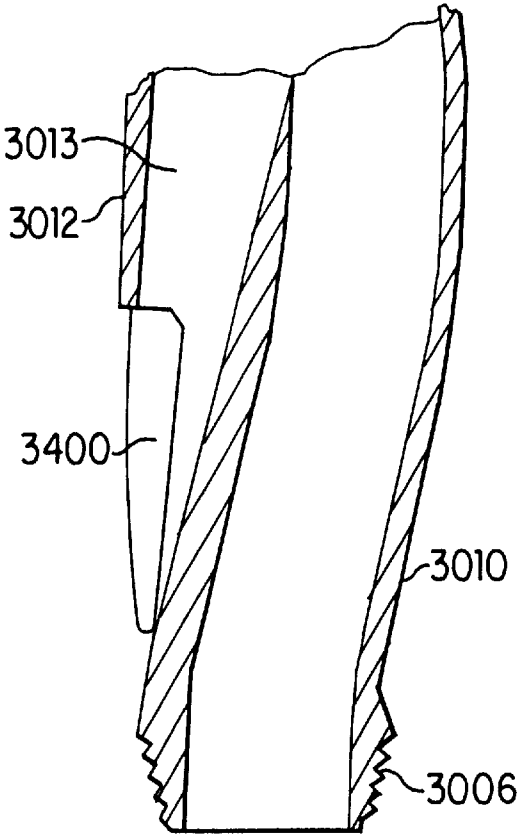

FIGS. 26A and 26B illustrate a drillable cap 3400 welded about the opening of lateral branching outlet 3012 in its retracted and expanded conditions, respectively. When conveying the casing string into the borehole, the cap 3400 isolates the lateral channel 3013 from the borehole and maintains a differential pressure across the casing wall which may be required to control the borehole pressure when casing is conveyed downhole. When the lateral branch is to be drilled, a drilling tool bores through cap 3400 and into a formation to form a lateral branch.

d) Description of Advantages and Features of Alternative Branching Sub

As mentioned above, a single branching sub 3000 can be provided with more than one lateral outlet. Such multiple outlets can be coplanar with each other or non-coplanar. A single branching sub 3000 can be connected in tandem with one or more other branching subs 3000 either at its top end or its bottom end. A branching sub 3000 can be provided with a foot at its lower end in a similar manner to foot 172 of FIG. 8A.

A lateral branching outlet 3012 of FIG. 20B may support a liner hanging packer which holds a liner connected to the housing 3002 in order to isolate the branching chamber 3008 from the borehole. Appropriate grooves at the top of the lateral branching outlet 3012 may be provided to secure the liner hanger and prevent the liner from accidentally moving out of the outlet during the liner setting operation or later. Alternatively, the interior wall of the lateral branching outlet 3012 can be provided without grooves.

The lateral branching outlet 3012 can be terminated with a ramp that guides the drilling bit when starting the drilling of the lateral borehole. Such ramp can prevent the drilling bit from accidentally drilling back toward the main pipe 3010.

Other structures may be provided inside the branching chamber 3008 such as a guidance ramp, secondary positioning groove, or the like to validate conveying equipment through the feed through channel 3011 or toward a specific lateral channel 3013. The branching chamber 3008, or the lateral branching outlet 3012, or the main pipe 3010, can be provided with temporary or permanent flow control devices such as valves, chokes, or temporary or permanent recording equipment with temperature, pressure or seismic sensors, for example. The branching chamber 3008 can also be provided with a production tubing interface with a flow connector, or a flow diverter, or an isolating packer. A lateral branching outlet 3012 can also be provided with an artificial lifting device such as a pump, gas influx injectors, and the like.

As an alternative to the apparatus and techniques of FIGS. 7–10 for expanding the main pipe 3010 and the lateral branching outlet 3012, an inflatable packer may be placed on the inside wall of the main pipe 3010 or the lateral branching outlet 3012 whereby the expansion force of the packer is used to expand the pipes by plastic deformation.

Various modifications and alterations in the described methods and apparatus will be apparent to those skilled in the art of the foregoing description which do not depart from the spirit of the invention. For this reason, such changes are desired to be included within the scope of the appended claims which include the only limitations to the present invention. The descriptive manner which is employed for setting forth the embodiments should be interpreted as illustrative but not limitative.

What is claimed is:

1. A branching sub for deployment in a borehole, comprising:

a branching chamber having an open first end of cylindrical shape adapted to connect with and to be carried by a string of well casing;

a plurality of branching outlet members in fluid communication with said first end, at least one of said plurality of outlet members being expandable and in a retracted state having a non-circular cross sectional shape, said plurality of outlet members collectively defining an effective outer diameter less than the diameter of said borehole; and wherein said at least one outlet member is adapted for expansion and forming to a circular cross sectional shape, the outlet members adapted to be expanded by forces that are opposite in direction to each other.

2. The branching sub of claim 1, further comprising a reaction body between at least two of said plurality of outlet members.

3. The branching sub of claim 2, wherein said reaction body comprises a wall region.

4. The branching sub of claim 2, wherein said reaction body is central to said plurality of outlet members.

5. The branching sub of claim 1, wherein the branching outlet members when retracted are totally with an imaginary cylinder that is coaxial with and of the same radius as the branching chamber, and wherein the branching outlet members have an expanded state in which the at least one outlet member extends from the branching chamber outwardly of the imaginary cylinder.

6. The branching sub of claim 5, wherein the at least one branching outlet member is adapted to extend in an arcuate path from the branching chamber outwardly of the imaginary cylinder.

7. The branching sub of claim 1, wherein at least another one of the outlet members is adapted for expansion and forming to a circular cross sectional shape.

8. The branching sub of claim 1, wherein at least two of the plurality of outlet members are predeformed so as to have substantially identical cross sectional shapes.

9. The branching sub of claim 1, further comprising a stiffening structure provided at least at a juncture between two of the branching outlet members.

10. The branching sub of claim 1, further comprising a stiffening structure provided at the juncture between each of the branching outlet members.

11. The branching sub of claim 1, further comprising:

a leg member carried substantially axially downwardly from a second end of the branching chamber; and a foot disposed at a distal end of the leg.

12. An apparatus for use in the borehole, comprising:

the string of well casing; and the branching sub of claim 1 connected to the string of well casing.

13. A branching sub for deployment in a borehole, comprising:

an open first end of cylindrical shape adapted to connect with and to be carried by a string of well casing;

a plurality of branching outlet members in fluid communication with said first end, at least one of said plurality of outlet members being expandable and in a retracted state having a non-circular cross sectional shape, said plurality of outlet members collectively defining an effective outer diameter no greater than the diameter of said first end; and wherein said at least one outlet member is adapted for expansion and forming to a circular cross sectional shape, the outlet members adapted to be expanded by forces that are opposite in direction to each other.

14. The branching sub of claim 13, further comprising a reaction body between at least two of said plurality of outlet members.

15. The branching sub of claim 14, wherein said reaction body comprises a wall region.

16. The branching sub of claim 14, wherein said reaction body is central to said plurality of outlet members.

17. The branching sub of claim 13, further comprising a branching chamber having the pen first end, wherein the branching outlet members when retracted are totally with an imaginary cylinder that is coaxial with and of the same radius as the branching chamber, and wherein the branching outlet members have an expanded state in which the at least one outlet member extends from the branching chamber outwardly of the imaginary cylinder.

18. The branching sub of claim 17, wherein the at least one branching outlet member is adapted to extend in an arcuate path from the branching chamber outwardly of the imaginary cylinder.

19. The branching sub of claim 13, wherein at least another one of the outlet members is adapted for expansion and forming to a circular cross sectional shape.

20. The branching sub of claim 13, wherein at least two of the plurality of outlet members are predeformed so as to have substantially identical cross sectional shapes.

21. The branching sub of claim 13, further comprising a stiffening structure provided at least at a juncture between two of the branching outlet members.

22. The branching sub of claim 13, further comprising a stiffening structure provided at the juncture between each of the branching outlet members.

23. The branching sub of claim 13, further comprising:

a branching chamber having the open first end;

a leg member carried substantially axially downwardly from a second end of the branching chamber; and a foot disposed at a distal end of the leg.

24. An apparatus for use in the borehole, comprising:

the string of well casing; and the branching sub of claim 13 connected to the string of well casing.

25. A branching sub for deployment in a parent well, comprising:

an open first end having a generally cylindrical shape, the first end adapted for attachment to a casing;

at least two outlet members adapted to provide fluid communication therethrough, the at least two outlet members in fluid communication with the first end; and each of the at least two outlet members predeformed along a plane extending the length of the respective outlet member, wherein the at least two outlet members are adapted for expansion by applying opposing force generally at the two lines formed at the intersection of the respective plane with the respective outlet member.

26. The sub as claimed in claim 25, wherein:

each of the planes extends through a longitudinal axis of the sub.

27. The sub as claimed in claim 25, further comprising:

a reaction body of the sub positioned at the intersection of at least two of the planes.

28. A branching sub for deployment in a parent well, comprising:

an open first end having a generally cylindrical shape, the first end adapted for attachment to a casing;

at least two outlet members adapted to provide fluid communication therethrough, the at least two outlet members in fluid communication with the first end; and a plurality of the at least two outlet members adapted to be expanded by forces that are opposite in direction to each other.

* * * * *